US007549813B2

(12) United States Patent
Endo

(10) Patent No.: US 7,549,813 B2
(45) Date of Patent: Jun. 23, 2009

(54) PRINTER, PRINTING METHOD, PROGRAM, COMPUTER SYSTEM

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 192 days.

(21) Appl. No.: 10/520,118

(22) PCT Filed: Jul. 1, 2003

(86) PCT No.: PCT/JP03/08371

§ 371 (c)(1),
(2), (4) Date: Nov. 21, 2005

(87) PCT Pub. No.: WO2004/005035

PCT Pub. Date: Jan. 15, 2004

(65) Prior Publication Data

US 2006/0169161 A1 Aug. 3, 2006

(30) Foreign Application Priority Data

Jul. 4, 2002 (JP) ..... 2002-196237

(51) Int. Cl.
*B41J 11/00* (2006.01)

(52) U.S. Cl. ..... 400/579; 400/578; 400/630

(58) Field of Classification Search ..... 400/578, 400/579, 708, 630–633.2, 709–709.2; 347/16, 347/19, 101, 104–107; 271/8.1, 226–255
See application file for complete search history.

(56) References Cited

U.S. PATENT DOCUMENTS 5,397,192 A * 3/1995 Khormaee ..... 400/708
5,466,079 A * 11/1995 Quintana ..... 400/579
5,564,848 A * 10/1996 Quintana ..... 400/708
6,666,600 B1 * 12/2003 Shirota et al. ..... 400/579

(Continued)

FOREIGN PATENT DOCUMENTS

EP 0 556 045 A2 8/1993

(Continued)

*Primary Examiner*—Jill E Culler
*Assistant Examiner*—Wyn' Q Ha
(74) *Attorney, Agent, or Firm*—Sughrue Mion, PLLC

(57) ABSTRACT

The print start position, in a predetermined direction, of a medium to be printed is determined with high precision and efficiency. A printing apparatus causes the detection means to be positioned on one side in the movement direction; causes the carrying means to carry the medium to be printed in a predetermined direction up to a detection position where the detection means detects the medium to be printed; and when an upper end, among an upper right end and an upper left end of the medium to be printed, that is on a side opposite from a side where the detection means is positioned is leading by at least a set amount at the detection position, causes the detection means to move to the other side opposite from the one side in the movement direction, then causes the carrying means to carry the medium to be printed from the detection position in a direction opposite from the predetermined direction, then causes the medium to be printed to be carried in the predetermined direction up to the detection position where the detection means detects the medium to be printed, and then causes the medium to be printed to be carried by a predetermined amount in the predetermined direction from the detection position.

12 Claims, 13 Drawing Sheets

U.S. PATENT DOCUMENTS

| | | | | |
|---|---|---|---|---|
| 6,840,691 | B2 * | 1/2005 | Isono et al. | 400/579 |
| 6,984,082 | B2 * | 1/2006 | Endo | 400/579 |
| 2005/0175386 | A1 * | 8/2005 | Romine | 400/579 |

FOREIGN PATENT DOCUMENTS

| | | | | |
|---|---|---|---|---|
| EP | 1 195 248 | A1 | | 6/2000 |
| EP | 1 213 150 | A1 | | 6/2002 |
| EP | 1 449 662 | A1 | | 8/2004 |
| EP | 1 449 670 | A1 | | 8/2004 |
| JP | 60257279 | A | * | 12/1985 |
| JP | 02255369 | A | * | 10/1990 |
| JP | 04021482 | A | * | 1/1992 |
| JP | 04022667 | A | * | 1/1992 |
| JP | 04022668 | A | * | 1/1992 |
| JP | 4-39074 | A | | 2/1992 |
| JP | 06293163 | A | * | 10/1994 |
| JP | 8-132697 | A | | 5/1996 |
| JP | 9-1880 | A | | 1/1997 |
| JP | 09024653 | A | * | 1/1997 |
| JP | 10-291689 | A | | 11/1998 |
| JP | 10291689 | A | * | 11/1998 |
| JP | 11048556 | A | * | 2/1999 |
| JP | 11116100 | A | * | 4/1999 |
| JP | 11-170639 | A | | 6/1999 |
| JP | 11170639 | A | * | 6/1999 |
| JP | 11170640 | A | * | 6/1999 |
| JP | 11-193152 | A | | 7/1999 |
| JP | 11184590 | A | * | 7/1999 |
| JP | 2000191183 | A | * | 7/2000 |
| JP | 2001001617 | A | * | 1/2001 |
| JP | 2004009529 | A | * | 1/2004 |
| JP | 2007245485 | A | * | 9/2007 |

* cited by examiner (a)

(b)

PRINTER, PRINTING METHOD, PROGRAM, COMPUTER SYSTEM

TECHNICAL FIELD

The present invention relates to printing apparatuses, printing methods, programs, and computer systems. In particular, the present invention relates to a printing apparatus provided with detection means that is capable of moving and that is for detecting a medium to be printed, and carrying means for carrying the medium to be printed in a direction that intersects a movement direction of the detection means, a printing method for such a printing apparatus, a program for controlling such a printing apparatus, and a computer system provided with such a printing apparatus.

BACKGROUND ART

Inkjet printers that print by intermittently ejecting ink are known as printing apparatuses for printing images onto various types of media to be printed, such as paper, cloth, and film. With such inkjet printers, printing is carried out by repeating in alternation a process of positioning a medium to be printed by carrying it in a direction toward a print head, and a process of ejecting ink while moving the print head in a main-scanning direction that intersects the carrying direction in which the medium to be printed is carried.

When carrying the medium to be printed in the direction toward the print head, if the medium is carried with either its upper right end or its upper left end leading the other, that is, if the medium to be printed is skewed in the carrying direction, then the actual print position on the medium to be printed deviates from the anticipated print position, and this affects the quality of the image. In particular, in the case of performing borderless printing, if a blank area is formed at the upper edge of the medium to be printed due to the medium to be printed being skewed in the carrying direction, there is a possibility that the medium to be printed may be rendered useless. On the other hand, when performing borderless printing, increasing the margin of the print range in order to cover the entire medium to be printed reduces the possibility that a blank area will be formed at the upper edge of the medium to be printed, but it also carries the possibility that the amount of ink that is consumed will increase.

The present invention was arrived at in light of the foregoing issues, and it is an object thereof to achieve a printing apparatus, a printing method, a program, and a computer system with which the print start position of a medium to be printed can be determined very precisely and efficiently.

DISCLOSURE OF INVENTION

A primary aspect of the present invention is a printing apparatus comprising: detection means that is capable of moving and that is for detecting a medium to be printed; and carrying means for carrying the medium to be printed in a direction that intersects a movement direction of the detection means; the printing apparatus causing the detection means to be positioned on one side in the movement direction; causing the carrying means to carry the medium to be printed in a predetermined direction up to a detection position where the detection means detects the medium to be printed; and when an upper end, among an upper right end and an upper left end of the medium to be printed, that is on a side opposite from a side where the detection means is positioned is leading by at least a set amount at the detection position, causing the detection means to be positioned on the other side that is opposite from the one side in the movement direction, then causing the carrying means to carry the medium to be printed from the detection position in a direction opposite from the predetermined direction, then causing the medium to be printed to be carried in the predetermined direction up to the detection position where the detection means detects the medium to be printed, and then causing the medium to be printed to be carried by a predetermined amount in the predetermined direction from the detection position.

Features and objects of the present invention other than the above will become clear through the description of the present specification and the accompanying drawings.

Figure 1:
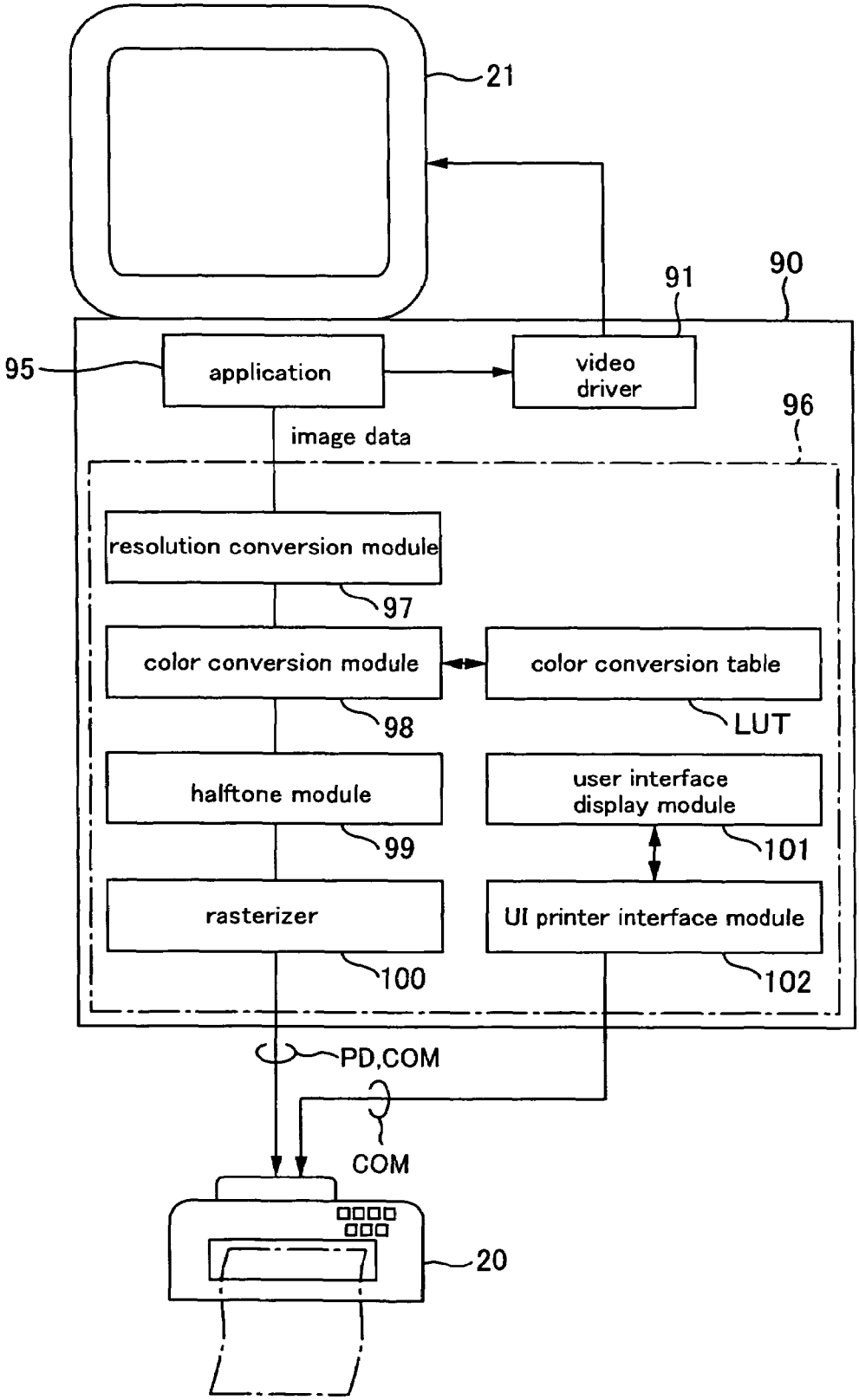
FIG. 1 is a block diagram showing an example configuration of a computer system of the present invention.

A legend of the main reference numerals used in the drawings is shown below.

11 linear encoder
12 linear scale
13 rotary encoder
14 detecting section
20 color inkjet printer
21 CRT
22 paper stacker
24 paper feed roller
25 pulley
26 platen
28 carriage

29 reflective optical sensor
30 carriage motor
31 paper feed motor
32 pull belt
34 guide rail
36 print head
38 light-emitting member
40 light-receiving member
50 buffer memory
52 image buffer
54 system controller
56 main memory
57 RAM
58 EEPROM
61 main-scan drive circuit
62 sub-scan drive circuit
63 head drive circuit
65 reflective optical sensor control circuit
66 electric signal measuring section
90 computer
91 video driver
95 application program
96 printer driver
97 resolution conversion module
98 color conversion module
99 halftone module
100 rasterizer
101 user interface display module
102 UI printer interface module

BEST MODE FOR CARRYING OUT THE INVENTION

At least the following matters will be made clear by the description of the present specification and the accompanying drawings.

A printing apparatus comprises:

detection means that is capable of moving and that is for detecting a medium to be printed; and carrying means for carrying the medium to be printed in a direction that intersects a movement direction of the detection means;

the printing apparatus causing the detection means to be positioned on one side in the movement direction;

causing the carrying means to carry the medium to be printed in a predetermined direction up to a detection position where the detection means detects the medium to be printed; and when an upper end, among an upper right end and an upper left end of the medium to be printed, that is on a side opposite from a side where the detection means is positioned is leading by at least a set amount at the detection position, causing the detection means to be positioned on the other side that is opposite from the one side in the movement direction, then causing the carrying means to carry the medium to be printed from the detection position in a direction opposite from the predetermined direction, then causing the medium to be printed to be carried in the predetermined direction up to the detection position where the detection means detects the medium to be printed, and then causing the medium to be printed to be carried by a predetermined amount in the predetermined direction from the detection position.

According to the foregoing printing apparatus, only when an upper end, of among an upper right end or an upper left end of the medium to be printed, that is on a side opposite from a side where the detection means is positioned is leading the other by at least a set amount at the detection position, the detection means is positioned on the other side from the one side, the medium to be printed is carried from the detection position in a direction opposite from the predetermined direction, the medium to be printed is carried in the predetermined direction up to a detection position where the detection means detects the medium to be printed, and then the medium to be printed is carried by a predetermined amount in the predetermined direction from the detection position. Thus, the print start position, in the predetermined direction, of the medium to be printed can be determined very accurately and efficiently. That is, the formation of blank areas at the upper edge of the medium to be printed and an increase in ink consumption when borderless printing is performed are eliminated.

Further, in this printing apparatus, when an upper end, among the upper right end and the upper left end of the medium to be printed, that is on the side where the detection means is positioned is leading at the detection position, the medium to be printed may be carried by the carrying means in the predetermined direction from the detection position by the predetermined amount.

Further, in this printing apparatus, when the upper end, among the upper right end and the upper left end of the medium to be printed, that is on the side opposite from the side where the detection means is positioned is leading by less than the set amount at the detection position, the medium to be printed may be carried by the carrying means in the predetermined direction from the detection position by the predetermined amount.

According to the foregoing printing apparatus, the medium to be printed is carried as it is from the detection position in the predetermined direction by the predetermined amount in a case where the upper end, among the upper right end and the upper left end of the medium to be printed, that is on the side opposite from the side where the detection means is positioned is leading the other only by an amount that is less than the set amount at the detection position. Thus, the print start position, in the predetermined direction, of the medium to be printed can be determined very accurately and efficiently.

Further, this printing apparatus may be provided with a print head for printing on the medium to be printed by ejecting ink as the print head moves in a main-scanning direction that intersects the carrying direction in which the medium to be printed is carried.

According to the foregoing printing apparatus, the print start position, in the predetermined direction, of the medium to be printed can be determined very accurately and efficiently in cases where there is a print head that can move in a main-scanning direction that intersects the carrying direction in which the medium to be printed is carried.

Further, in this printing apparatus, the detection means may be provided together with the print head in/on a moving member for moving in the main-scanning direction.

According to the foregoing printing apparatus, the print start position, in the predetermined direction, of the medium to be printed can be determined very accurately and efficiently using the detection means that is provided together with the print head in/on the moving member.

Further, in this printing apparatus, the upper end, among the upper right end and the upper left end of the medium to be printed, that is leading at the detection position may be found by detecting whether or not the medium to be printed is present by moving the detection means from the one side to the other side in the movement direction after carrying the medium to be printed in the predetermined direction up to the detection position where the detection means positioned on the one side in the movement direction detects the medium to be printed.

According to the foregoing printing apparatus, it is possible to determine the print start position, in a predetermined direction, of the medium to be printed very accurately and efficiently using the detection means for detecting whether or not the medium to be printed is present by moving from one side to the other side in a movement direction after the medium to be printed is carried in the predetermined direction up to the detection position where the detection means positioned on the one side in the movement direction detects the medium to be printed.

Further, in this printing apparatus, it may be made difficult for the detection means to detect the medium to be printed when the detection means is moved from the one side to the other side in the movement direction.

According to the foregoing printing apparatus, by setting the apparatus to a setting where it is made difficult for the detection means to detect the medium to be printed, the medium to be printed is kept from being carried in the direction opposite from the predetermined direction if the upper end, among the upper right end and the upper left end of the medium to be printed, that is on the side opposite from the side where the detection means is positioned is leading by less than a set amount. Thus, it is possible to determine the print start position, in the predetermined direction, of the medium to be printed more efficiently.

Further, in this printing apparatus, in the process of moving the detection means from the one side to the other side in the movement direction, if the detection means does not detect the medium to be printed, then it is assumed that the upper end, among the upper right end and the upper left end of the medium to be printed, that is on the one side in the movement direction of the detection means is leading at the detection position, or that the upper end, among the upper right end and the upper left end of the medium to be printed, that is on the other side in the movement direction of the detection means is leading by less than the set amount; and if the detection means detects the medium to be printed, then it is assumed that the upper end, among the upper right end and the upper left end of the medium to be printed, that is on the other side in the movement direction of the detection means is leading by at least the set amount.

According to the foregoing printing apparatus, when the detection means does not detect the medium to be printed, then it is assumed that the upper end, among the upper right end and the upper left end of the medium to be printed, that is on the one side in the movement direction of the detection means is leading at the detection position, or that the upper end, among the upper right end and the upper left end of the medium to be printed, that is on the other side in the movement direction of the detection means is leading only by an amount that is less than the set amount. Thus, the medium to be printed is kept from being carried in the direction opposite from the predetermined direction, allowing the print start position, in the predetermined direction, of the medium to be printed to be determined more efficiently.

Further, in this printing apparatus, the detection means may have a light-emitting member for emitting light and a light-receiving member for receiving the light that is emitted by the light-emitting member, and may detect the medium to be printed based on an output value of the light-receiving member.

According to the foregoing printing apparatus, the print start position, in the predetermined direction, of the medium to be printed can be determined very accurately and efficiently using the detection means, which includes a light-emitting member and a light-receiving member.

Further, in this printing apparatus, the print head may perform printing with respect to an entire surface of the medium to be printed.

According to the foregoing printing apparatus, it is possible to determine the print start position, in the predetermined direction, of the medium to be printed very accurately and efficiently in cases where printing is carried out with respect to the entire surface of the medium to be printed.

It is also possible to achieve a printing apparatus comprising: detection means that is capable of moving and that is for detecting a medium to be printed; and carrying means for carrying the medium to be printed in a direction that intersects a movement direction of the detection means;

the printing apparatus causing the detection means to be positioned on one side in the movement direction; causing the carrying means to carry the medium to be printed in a predetermined direction up to a detection position where the detection means detects the medium to be printed; when an upper end, among an upper right end and an upper left end of the medium to be printed, that is on a side where the detection means is positioned is leading at the detection position, causing the medium to be printed to be carried by the carrying means in the predetermined direction from the detection position by a predetermined amount; when an upper end, among the upper right end and the upper left end of the medium to be printed, that is on a side opposite from the side where the detection means is positioned is leading by at least a set amount at the detection position, causing the detection means to be positioned on the other side that is opposite from the one side in the movement direction, then causing the carrying means to carry the medium to be printed from the detection position in a direction opposite from the predetermined direction, then causing the medium to be printed to be carried in the predetermined direction up to the detection position where the detection means detects the medium to be printed, and then causing the medium to be printed to be carried by the predetermined amount in the predetermined direction from the detection position; when the upper end, among the upper right end and the upper left end of the medium to be printed, that is on the side opposite from the side where the detection means is positioned is leading by less than the set amount at the detection position, causing the medium to be printed to be carried by the carrying means in the predetermined direction from the detection position by the predetermined amount; printing on the medium to be printed by causing a print head to eject ink as the print head moves in a main-scanning direction that intersects the carrying direction in which the medium to be printed is carried; being provided with the detection means and the print head both in/on a moving member for moving in the main-scanning direction; finding the upper end, among the upper right end and the upper left end of the medium to be printed, that is leading at the detection position by detecting whether or not the medium to be printed is present by moving the detection means from the one side to the other side in the movement direction after carrying the medium to be printed in the predetermined direction up to the detection position where the detection means positioned on the one side in the movement direction detects the medium to be printed; when the detection means is moved from the one side to the other side in the movement direction, making it difficult for the detection means to detect the medium to be printed so that if the detection means does not detect the medium to be printed, then it is assumed that the upper end, among the upper right end and the upper left end of the medium to be printed, that is on the one side in the movement direction of the detection means is leading at the detection position, or that the upper end, among the upper right end and the upper left end of the medium to be printed, that is on the other side in the movement direction of the detection means is leading by less than the set amount, and if the detection means detects the medium to be printed, then it is assumed that the upper end, among the upper right end and the upper left end of the medium to be printed, that is on the other side in the movement direction of the detection means is leading by at least the set amount; and performing printing with respect to an entire surface of the medium to be printed.

Further, a printing method for a printing apparatus provided with a sensor that is capable of moving and that is for detecting a medium to be printed, and a carry roller for carrying the medium to be printed in a direction that intersects a movement direction of the sensor, comprises:

a step of causing the sensor to be positioned on one side in the movement direction;

a step of causing the carry roller to carry the medium to be printed in a predetermined direction up to a detection position where the sensor detects the medium to be printed; and a step of, when an upper end, among an upper right end and an upper left end of the medium to be printed, that is on a side opposite from a side where the sensor is positioned is leading by at least a set amount at the detection position, causing the sensor to be positioned on the other side that is opposite from the one side in the movement direction, then causing the carry roller to carry the medium to be printed from the detection position in a direction opposite from the predetermined direction, then causing the medium to be printed to be carried in the predetermined direction up to the detection position where the sensor detects the medium to be printed, and then causing the medium to be printed to be carried by a predetermined amount in the predetermined direction from the detection position.

The foregoing printing method allows the print start position, in the predetermined direction, of the medium to be printed to be determined very accurately and efficiently.

Further, a program causes a printing apparatus provided with detection means that is capable of moving and that is for detecting a medium to be printed, and carrying means for carrying the medium to be printed in a direction that intersects a movement direction of the detection means, to achieve:

a function of causing the detection means to be positioned on one side in the movement direction;

a function of causing the carrying means to carry the medium to be printed in a predetermined direction up to a detection position where the detection means detects the medium to be printed; and a function of, when an upper end, among an upper right end and an upper left end of the medium to be printed, that is on a side opposite from a side where the detection means is positioned is leading by at least a set amount at the detection position, causing the detection means to be positioned on the other side that is opposite from the one side in the movement direction, then causing the carrying means to carry the medium to be printed from the detection position in a direction opposite from the predetermined direction, then causing the medium to be printed to be carried in the predetermined direction up to the detection position where the detection means detects the medium to be printed, and then causing the medium to be printed to be carried by a predetermined amount in the predetermined direction from the detection position.

The foregoing program allows controlling to be executed such that the print start position, in the predetermined direction, of the medium to be printed is determined very accurately and efficiently.

It is also possible to achieve a computer system comprising:

a printing apparatus provided with detection means that is capable of moving and that is for detecting a medium to be printed, and carrying means for carrying the medium to be printed in a direction that intersects a movement direction of the detection means; and a main computer unit that is connected to the printing apparatus;

the computer system causing the detection means to be positioned on one side in the movement direction;

causing the carrying means to carry the medium to be printed in a predetermined direction up to a detection position where the detection means detects the medium to be printed; and when an upper end, among an upper right end and an upper left end of the medium to be printed, that is on a side opposite from a side where the detection means is positioned is leading by at least a set amount at the detection position, causing the detection means to be positioned on the other side that is opposite from the one side in the movement direction, then causing the carrying means to carry the medium to be printed from the detection position in a direction opposite from the predetermined direction, then causing the medium to be printed to be carried in the predetermined direction up to the detection position where the detection means detects the medium to be printed, and then causing the medium to be printed to be carried by a predetermined amount in the predetermined direction from the detection position.

It is also possible to achieve a printing apparatus comprising:

a sensor that is capable of moving and that is for detecting a medium to be printed; and a carry roller for carrying the medium to be printed in a direction that intersects a movement direction of the sensor;

the printing apparatus causing the sensor to be positioned on one side in the movement direction;

causing the carry roller to carry the medium to be printed in a predetermined direction up to a detection position where the sensor detects the medium to be printed; and when an upper end, among an upper right end and an upper left end of the medium to be printed, that is on a side opposite from a side where the sensor is positioned is leading by at least a set amount at the detection position, causing the sensor to be positioned on the other side that is opposite from the one side in the movement direction, then causing the carry roller to carry the medium to be printed from the detection position in a direction opposite from the predetermined direction, then causing the medium to be printed to be carried in the predetermined direction up to the detection position where the sensor detects the medium to be printed, and then causing the medium to be printed to be carried by a predetermined amount in the predetermined direction from the detection position.

===Example of the Overall Configuration of the Apparatus===

An overview of a color inkjet printer serving as an example of a printing apparatus is described below with reference to FIG. 1. FIG. 1 is a block diagram showing an example configuration of a computer system of the present invention. In FIG. 1, a color inkjet printer 20 serves as the printing apparatus, and a computer system is constituted by the color inkjet printer 20, a computer 90, a display device (such as a CRT 21 or a LCD that is not shown), input devices (such as a keyboard and a mouse that are not shown), and a drive device (such as a flexible drive device or a CD-ROM drive device that are not shown).

The computer 90 has a video driver 91 for driving display of the CRT 21, a printer driver 96 for driving printing of the color inkjet printer 20, and an application program 95 for controlling driving of the video driver 91 and the printer driver 96. In accordance with a display command from the application program 95, the video driver 91 suitably processes image data to be processed and supplies them to the CRT 21. The CRT 21 displays an image corresponding to the image data supplied from the video driver 91. Also, in accordance with a print command from the application program 95, the printer driver 96 suitably processes image data to be processed and supplies them to the color inkjet printer 20 as print data PD.

The printer driver 96 is provided with a resolution conversion module 97, a color conversion module 98, a halftone module 99, a rasterizer 100, a user interface display module 101, a UI printer interface module 102, and a color conversion lookup table LUT.

The resolution conversion module 97 converts the resolution of the color image data formed based on the application program 95 into a resolution for printing. It should be noted that the color image data after conversion by the color conversion module 97 are made of the three color components RGB. Therefore, the color conversion module 98 references the color conversion lookup table LUT and converts, pixel by pixel, the RGB color image data having been output from the resolution conversion module 97 into multi-gradation data of a plurality of ink colors that can be used by the color inkjet printer 20. It should be noted that the multi-gradation data after conversion by the color conversion module 98 have a gradation value of 256 grades, for example. The halftone module 99 executes halftone processing with respect to the multi-gradation data that are output from the color conversion module 98 to create halftone image data. The rasterizer 100 arranges the halftone image data having been output from the halftone module 99 into a data order for supplying to the color inkjet printer 20, and supplies them to the color inkjet printer 20 as the print data PD mentioned above. It should be noted that the print data PD include raster data indicating how dots are to be formed when the print head moves in the main-scanning direction, and data indicating the carry amount by which to successively move the medium to be printed in the sub-scanning direction, which intersects the main-scanning direction.

The user interface display module 101 has a function for displaying various windows related to printing and a function for receiving instructions input from the user through these windows.

The UI printer interface module 102 is positioned between the user interface display module 101 and the color inkjet printer 20, and serves as a two-way interface between them. That is, when a user gives an instruction to the user interface display module 101, the UI printer interface module 102 serves as an interface by decoding commands from the user interface display module 101 and sending the various commands COM that are obtained to the color inkjet printer 20. Conversely, the UI printer interface module 102 also serves as an interface in the other direction by supplying various commands COM from the color inkjet printer 20 to the user interface display module 101.

As described above, the printer driver 96 achieves a function for supplying print data PD to the color inkjet printer 20 and a function for sending and receiving various types of commands COM to and from the color inkjet printer 20. It should be noted that a program for achieving the functions of the printer driver 96 is supplied to the computer 90 in a format in which it is stored on any one of various computer-readable storage media, including flexible disks, CD-ROMs, magneto optical disks, IC cards, ROM cartridges, punch cards, printed materials on which a code such as a bar code is printed, and internal storage devices and external storage devices of a computer. The program for achieving the functions of the printer driver 96 can also be downloaded onto the computer 90 from, for example, a publicly available WWW (World Wide Web) server on the Internet.

Figure 2:
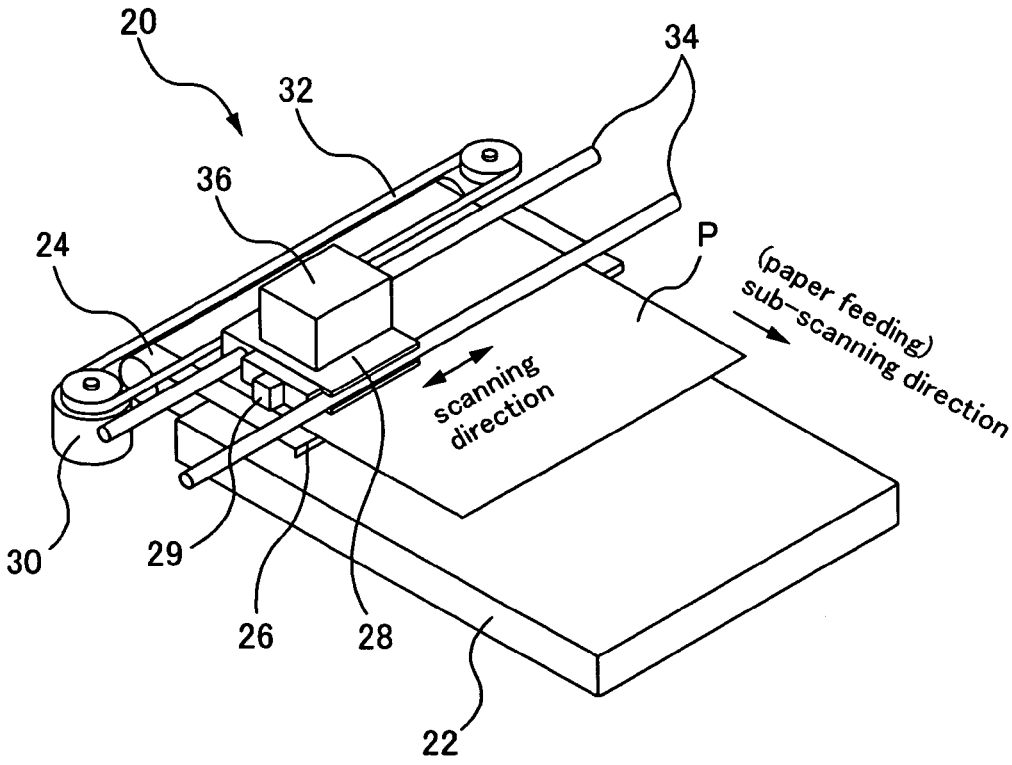
FIG. 2 is a schematic perspective view showing an example of a principal configuration of a color inkjet printer 20 shown in FIG. 1.

FIG. 2 is a schematic perspective view showing an example of the primary structures of the color inkjet printer 20 shown in FIG. 1. The color inkjet printer 20 is provided with a paper stacker 22, a paper feed roller 24 driven by a step motor that is not shown, a platen 26, a carriage 28 serving as a moving member, a carriage motor 30, a pull belt 32 that transmits the drive force of the carriage motor 30, and guide rails 34 for guiding the carriage 28. Also, the carriage 28 is provided with a print head 36 that has numerous nozzles for forming dots, and a reflective optical sensor 29 serving as a light-emitting member and a light-receiving member that will be described in detail later.

The carriage 28 is pulled by the pull belt 32, to which the drive force of the carriage motor 30 is transmitted, and moves in the main-scanning direction as shown in FIG. 2 along the guide rails 34. The print paper P is drawn from the paper stacker 22 and then rolled by the paper feed roller (also referred to as the "carry roller") 24, which is an example of the carrying means, and carried in the sub-scanning direction, which is perpendicular to the main-scanning direction shown in FIG. 2, over the surface of the platen 26. It should be noted that the paper feed roller 24 is driven when the operation for supplying the print paper P from the paper stacker 22 onto the platen 26 and the operation for discharging the print paper P from the platen 26 are performed.

===Example Configuration of the Reflective Optical Sensor===

Figure 3:
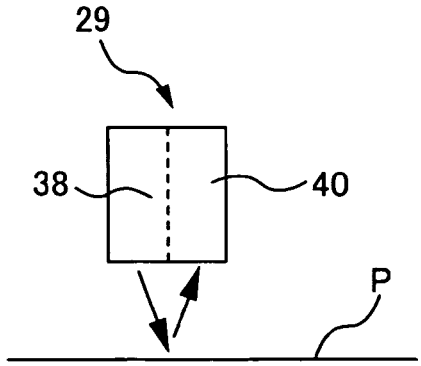
FIG. 3 is a schematic diagram for describing an example of the reflective optical sensor 29 provided in the carriage 28.

FIG. 3 is a schematic diagram for describing an example of the reflective optical sensor 29 provided in the carriage 28. The reflective optical sensor 29 has a light-emitting member 38 such as a light-emitting diode that emits light, and a light-receiving member 40 such as a phototransistor for receiving the light that is emitted by the light-emitting member. It should be noted that the light-emitting member 38 is not limited to the light-emitting diode mentioned above, and any member may be adopted as the light-emitting member 38 as long as the member can constitute an element for achieving the present invention by emitting light. Also, the light-receiving member 40 is not limited to the phototransistor mentioned above, and any member may be adopted as the light-receiving member 40 as long as the member can constitute an element for achieving the present invention by receiving the light from the light-emitting member 38.

The incident light that is emitted by the light-emitting member 38 has directionality, and if there is print paper P in the direction of incidence, then it is irradiated onto the print paper P, whereas if there is no print paper P in the direction of incidence, then it is irradiated onto the platen 26. The incident light that is irradiated onto the print paper P or the platen 26 is reflected, and the light that is reflected at this time is received by the light-receiving member 40 and converted into an electric signal as an output value corresponding to the intensity of the reflected light. That is, since the intensity of light reflected by the print paper P and the platen 26 is different, it is possible to determine whether or not the print paper P is in the direction of incidence of the reflective optical sensor 29 based on the intensity of the electric signal that is obtained from the light-receiving member 40. The intensity of the electric signal that is obtained from the light-receiving member 40 is measured by an electric signal measuring section 66, which is described later.

It should be noted that in this embodiment, the reflective optical sensor 29 is a single unit constituted by the light-emitting member 38 and the light-receiving member 40, but this is not a limitation. That is, it is also possible to adopt a configuration in which the light-emitting member 38 and the light-receiving member are separate members making up the reflective optical sensor 29, and this reflective optical sensor 29 is provided in/on the carriage 28.

Also, the electric signal corresponding to the intensity of the reflected light obtained from the light-receiving member 40 is measured in this embodiment, but this is not a limitation. That is, it is also possible to provide a means capable of measuring the intensity of the reflected light received by the light-receiving member 40 in a form other than an electric signal.

===Example Configuration of the Carriage Area===

Figure 4:
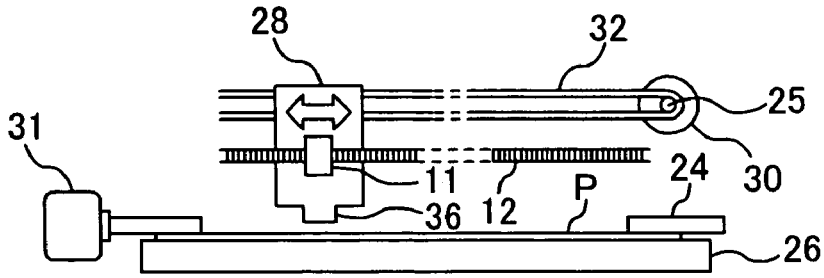
FIG. 4 is a diagram showing an example configuration of the periphery of the carriage 28 in the color inkjet printer 20.

FIG. 4 is a diagram showing an example of a configuration of the periphery of the carriage 28 in the color inkjet printer 20. The color inkjet printer 20 is provided with a paper feed motor (hereinafter referred to as "PF motor") 31 for carrying the print paper P, the carriage 28 in which the print head 36 for ejecting ink onto the print paper P is provided and which moves in the main-scanning direction, the carriage motor (hereinafter referred to as "CR motor") 30 for driving the carriage 28, a linear encoder 11 provided in the carriage 28, a linear scale 12 in which slits are formed at a predetermined spacing, the platen 26 for supporting the print paper P, the paper feed roller 24 to which the drive force of the PF motor 31 is transferred and which is for carrying the print paper P in the sub-scanning direction, a rotary encoder 13 for detecting the amount of rotation of the paper feed roller 24 (see FIG. 7), a pulley 25 provided about the rotational shaft of the CR motor 30, and the pull belt 32 stretched taut by the pulley 25.

Figure 5:
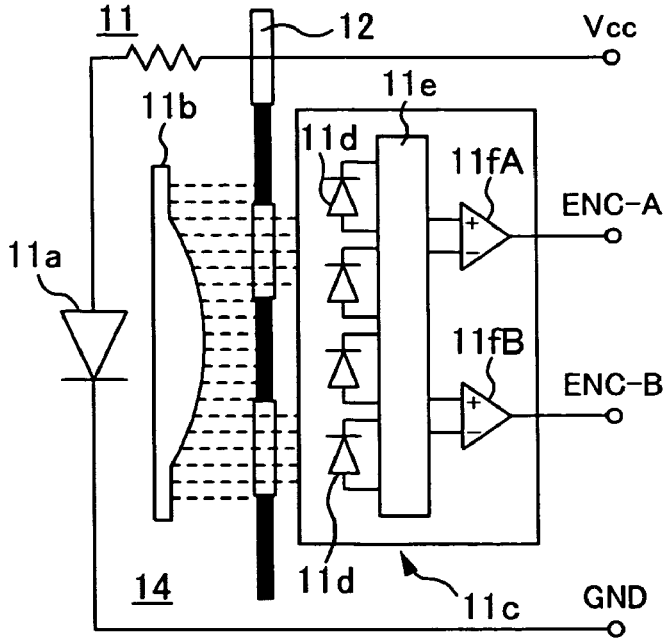
FIG. 5 is an explanatory diagram of the linear encoder 11.

FIG. 5 is an explanatory diagram of the linear encoder 11.

The linear encoder 11 is for detecting the position of the carriage 28, and has a linear scale 12 and a detecting section 14.

The linear scale 12 is provided with slits at a predetermined spacing (for example, 1/180 inch (1 inch=2.54 cm)), and is fastened to the color inkjet printer 20 side.

The detecting section 14 is provided in opposition to the linear scale 12 and on the carriage 28 side. The detecting section 14 has a light-emitting diode 11*a*, a collimating lens 11*b*, and a detection processing section 11*c*. The detection processing section 11*c* has a plurality (for example, four) photodiodes 11*d*, a signal processing circuit 11*e*, and two comparators 11*f*A and 11*f*B.

The light-emitting diode 11*a* emits light when a voltage Vcc is applied to it via resistors on the anode side. This light is incident on the collimating lens 11*b*. The collimating lens 11*b* turns the light emitted from the light-emitting diode 11*a* into parallel light, and irradiates the parallel light onto the linear scale 12. The parallel light that passes through the slits provided in the linear scale 12 passes through stationary slits that are not shown and is incident on the photodiodes 11*d*. The photodiodes 11*d* convert the incident light into electric signals. The electric signals that are output from the photodiodes 11*d* are compared in the comparators 11*f*A and 11*f*B and the results of these comparisons are output as pulses. Then, the pulse ENC-A and the pulse ENC-B that are output from the comparators 11*f*A and 11*f*B become the output of the linear encoder 11.

Figure 6:
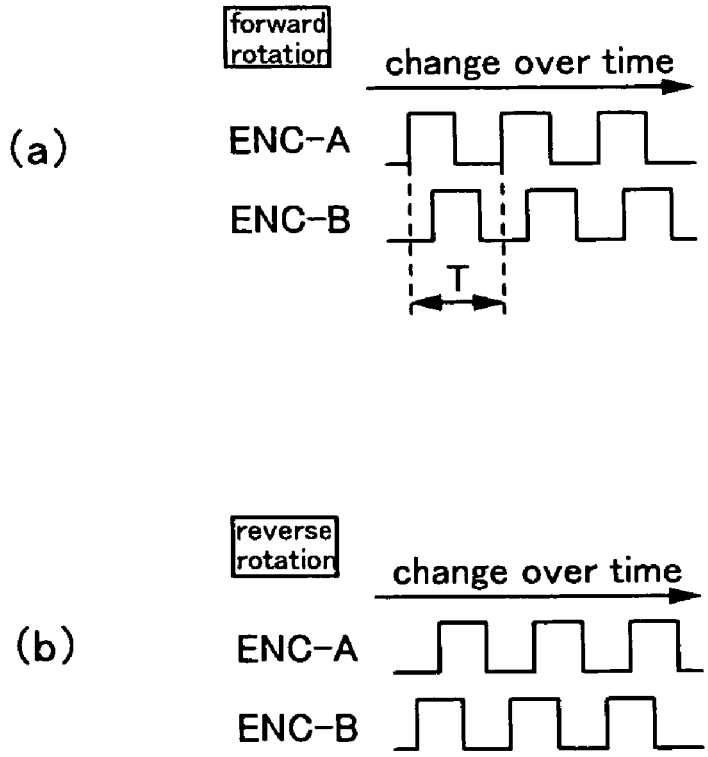
FIGS. 6(*a*) and 6(*b*) are timing charts showing the waveforms of the two types of output signals of the linear encoder 11.

FIG. 6 is a timing chart showing the waveforms of the two types of output signals of the linear encoder 11. FIG. 6(*a*) is a timing chart of the waveform of the output signal when the CR motor 30 is rotating forward. FIG. 6(*b*) is a timing chart showing the waveform of the output signal when the CR motor 30 is rotating in reverse.

As shown in FIG. 6(*a*) and FIG. 6(*b*), the phases of the pulse ENC-A and the pulse ENC-B are misaligned by 90 degrees both when the CR motor 30 is rotating forward and when it is rotating in reverse. When the CR motor 30 is rotating forward, that is, when the carriage 28 is moving in the main-scanning direction, then, as shown in FIG. 6(*a*), the phase of the pulse ENC-A leads the phase of the pulse ENC-B by 90 degrees. On the other hand, when the CR motor 30 is rotating in reverse, then, as shown in FIG. 6(*b*), the phase of the pulse ENC-A is delayed by 90 degrees with respect to the phase of the pulse ENC-B. A single period T of each pulse is equivalent to the time during which the carriage 28 is moved by the slit spacing of the linear scale 12 (for example, 1/180 inch (1 inch=2.54 cm)).

The position of the carriage 28 is detected as follows. First, the rising edges or the falling edges of the pulse ENC-A or ENC-B are detected, and the number of detected edges is counted. The position of the carriage 28 is calculated based on the counted number. With respect to the counted number, when the CR motor 30 is rotating forward, a "+1" is added for each detected edge, and when the CR motor 30 is rotating in reverse, a "−1" is added for each detected edge. The period of the pulses ENC is equal to the slit spacing of the linear scale 12, and thus, if the counted number is multiplied by the slit spacing, then the amount of movement from the position of the carriage 28 when to the count number is "0" can be obtained. That is, the resolution of the linear encoder 11 in this case is the slit spacing of the linear scale 12. It is also possible to use both the pulse ENC-A and the pulse ENC-B to detect the position of the carriage 30. The periods of the pulses ENC-A and ENC-B are equal to the slit spacing of the linear scale 12, and the phases of the pulse ENC-A and the pulse ENC-B differ by 90 degrees, so that by detecting the rising edges and the fallings edges of each pulse and counting the number of detected edges, a count number of "1" corresponds to ¼ of the slit spacing of the linear scale 12. Therefore, if the count number is multiplied by ¼ of the slit spacing, then the amount of movement from the position of the carriage 28 when the count number is "0" can be obtained. That is, the resolution of the linear encoder 11 in this case is ¼ the slit spacing of the linear scale 12.

It should be noted that the rotary encoder 13 has substantially the same configuration as the linear encoder 11, except that a not-shown rotation disk that rotates in conjunction with rotation of the paper feed roller 24 is used in place of the linear scale 12 provided on the color inkjet printer 20 side.

===Example of the Electrical Configuration of the Color Inkjet Printer===

Figure 7:
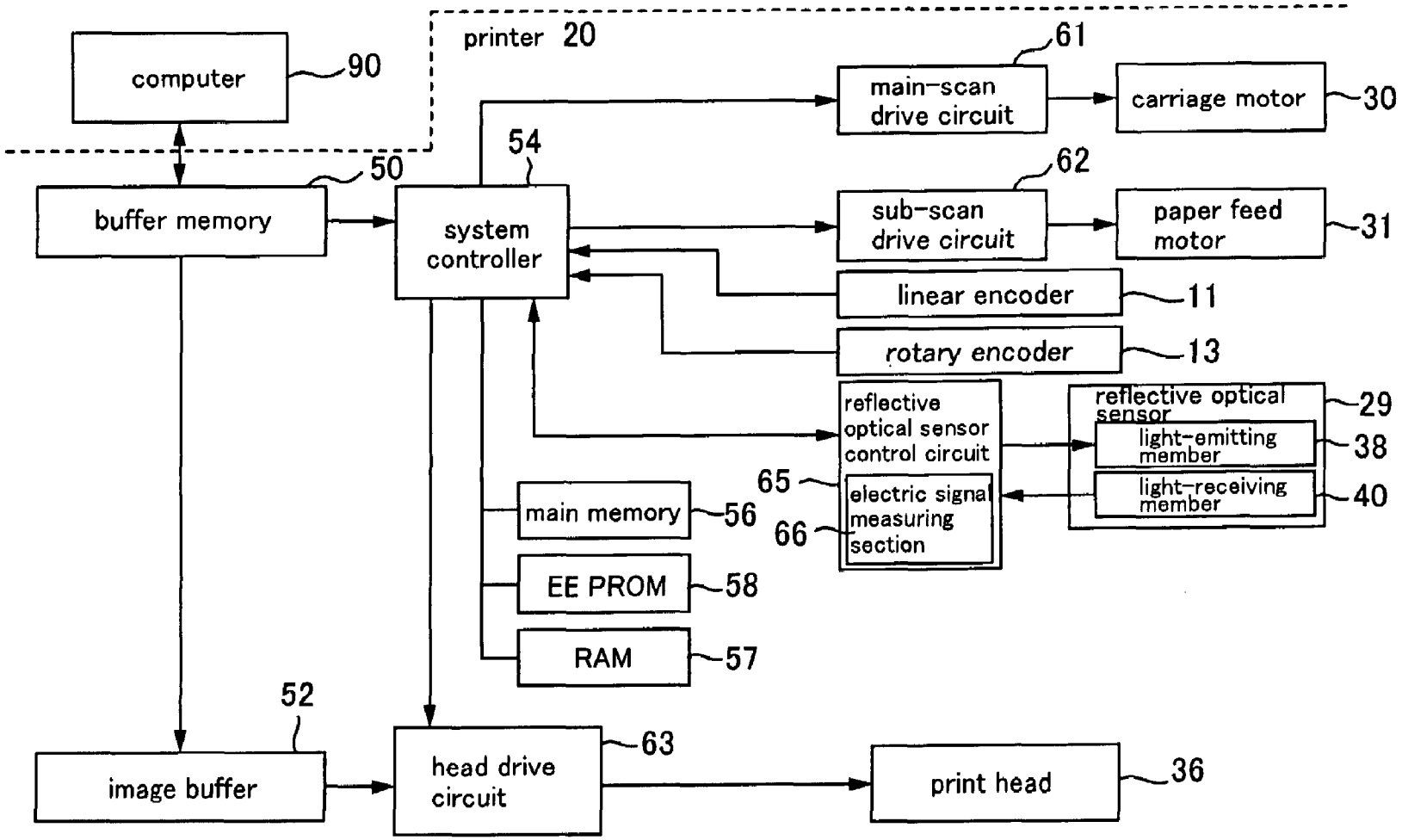
FIG. 7 is a block diagram showing an example of the electrical configuration of the color inkjet printer 20.

FIG. 7 is a block diagram showing an example of the electrical configuration of the color inkjet printer 20. In the color inkjet printer 20, a buffer memory 50 is for temporarily storing the signals supplied from the computer 90. An image buffer 52 is where the print data PD, of among the signals stored in the buffer memory 50, are supplied. A system controller 54 is where the various commands COM, of among the signals stored in the buffer memory 50, for controlling the operation of the color inkjet printer 20 are supplied.

The main memory 56 stores, in beforehand, program data for controlling the operation of the color inkjet printer 20 without regard to the interface between the computer 90 and the buffer memory 50, and a data table that can be referenced when controlling the operation of the color inkjet printer 20, for example, and is connected to the system controller 54. It should be noted that as the main memory 56 it is possible to adopt a nonvolatile memory (such as a mask ROM to which data are burned and fixed during manufacturing, an EPROM whose data can be erased with ultraviolet light, and an EEPROM with which data can be rewritten electrically) or a volatile memory (such as an SRAM that can hold data with the backup power source), but it is preferable that a nonvolatile memory is adopted because data can be reliably held.

The EEPROM 58 stores rewritten information, such as the remaining ink amount, that changes each time the printing operation is performed, and is connected to the system controller 54.

Moreover, the system controller 54 is connected to a RAM 57 for storing working data, a main-scan drive circuit 61 for driving the CR motor 30, a sub-scan drive circuit 62 for driving the PF motor 31, a head drive circuit 63 for driving the print head 36, a reflective optical sensor control circuit 65 for controlling the light-emitting member 38 and the light-receiving member 40 making up the reflective optical sensor 29, the linear encoder 11, and the rotary encoder 13. It should be noted that the reflective optical sensor control circuit 65 has an electric signal measuring section 66 for measuring the electric signals corresponding to the intensity of the reflected light obtained from the light-receiving member 40.

As detailed above, the system controller 54 decodes the various commands COM supplied from the buffer memory 50, and suitably supplies the command signals obtained as the result of this decoding to the main-scan drive circuit 61, the sub-scan drive circuit 62, and the head drive circuit 63, for example. In particular, the head drive circuit 63 reads the components of each color making up the print data PD from the image buffer 52 in accordance with the control signals supplied from the system controller 54, and according to these color components, drives the nozzle arrays of each color (black, yellow, magenta, cyan) making up the print head 36.

===Example of Nozzle Arrangement of Print===Head

Figure 8:
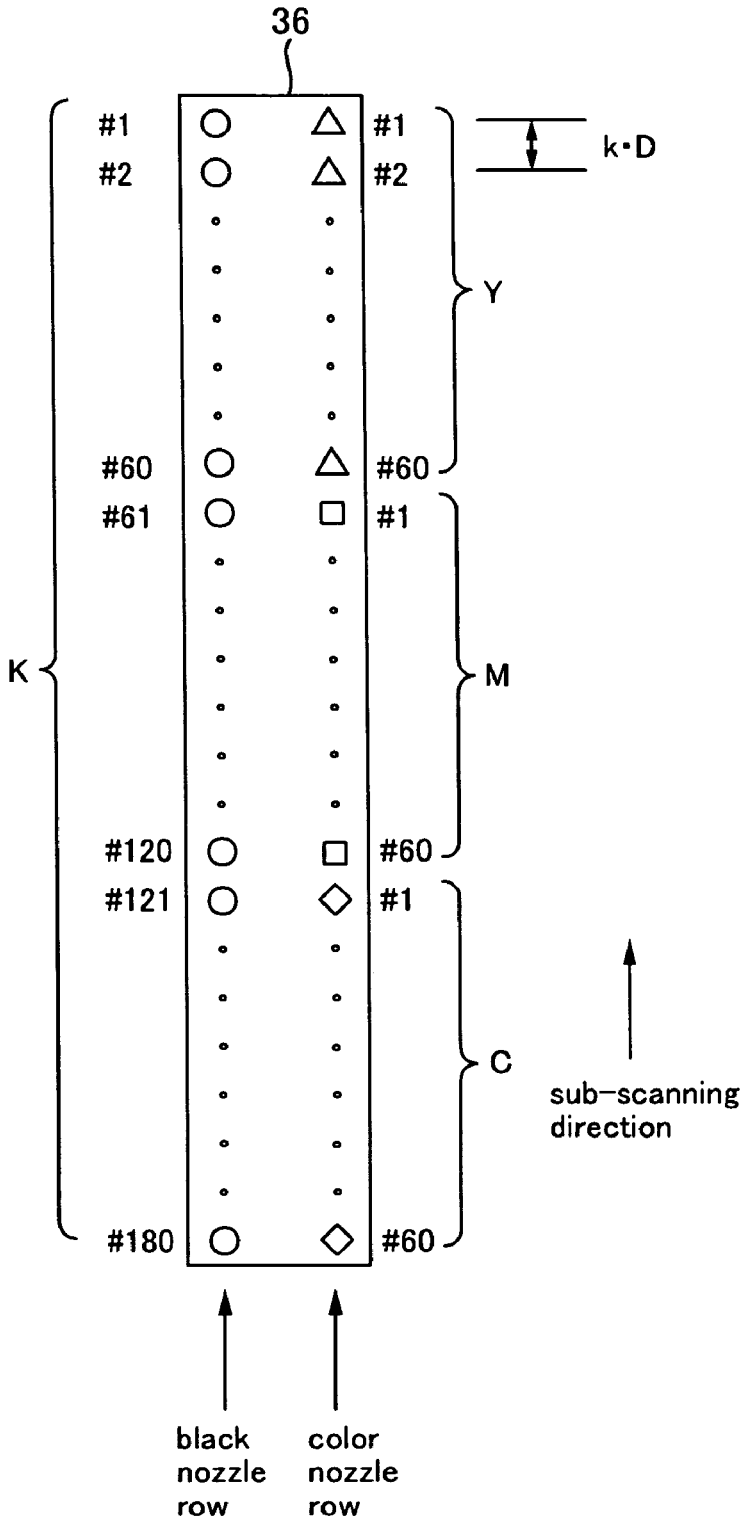
FIG. 8 is a diagram for describing the nozzle arrangement on the bottom surface of the print head 36.

FIG. 8 is a diagram for describing the arrangement of the nozzles in the bottom surface of the print head 36. The print head 36 has a black nozzle row K, and, as a color nozzle row, has a yellow nozzle row Y, a magenta nozzle row M, and a cyan nozzle row C formed in its bottom surface.

The black nozzle row K has 180 nozzles, nozzles #1 to #180 (white circles). The 180 nozzles #1 to #180 (white circles) are arranged in a straight line in the sub-scanning direction shown in FIG. 2 at a constant spacing (nozzle pitch k·D). Furthermore, the yellow nozzle row Y has 60 nozzles #1 to #60 (white triangles), the magenta nozzle row M has 60 nozzles #1 to #60 (white squares), and the cyan nozzle row C has 60 nozzles #1 to #60 (white diamonds). The 180 nozzles of these #1 to #60 nozzles (white triangles, white squares, and white diamonds) are arranged in the sub-scanning direction shown in FIG. 2 in a straight line at a constant spacing (nozzle pitch k·D). Here D is the smallest dot pitch in the sub-scanning direction (that is, the spacing at the highest resolution of the dots formed on the print paper P). For example, if the resolution is 1440 dpi, then the spacing is 1/1440 inch (approximately 17.65 μm). Furthermore, k is an integer of 1 or more.

For example, each nozzle is provided with a piezo element (not shown) as a drive element for driving the nozzle and making it eject droplets of ink.

It should be noted that, during printing, the print paper P is carried intermittently in the sub-scanning direction by a predetermined carry amount, and between these intermittent carries the carriage 28 moves in the main-scanning direction and ink droplets are ejected from the nozzles.

===Printing Method of the Present Embodiment===

Figure 9:
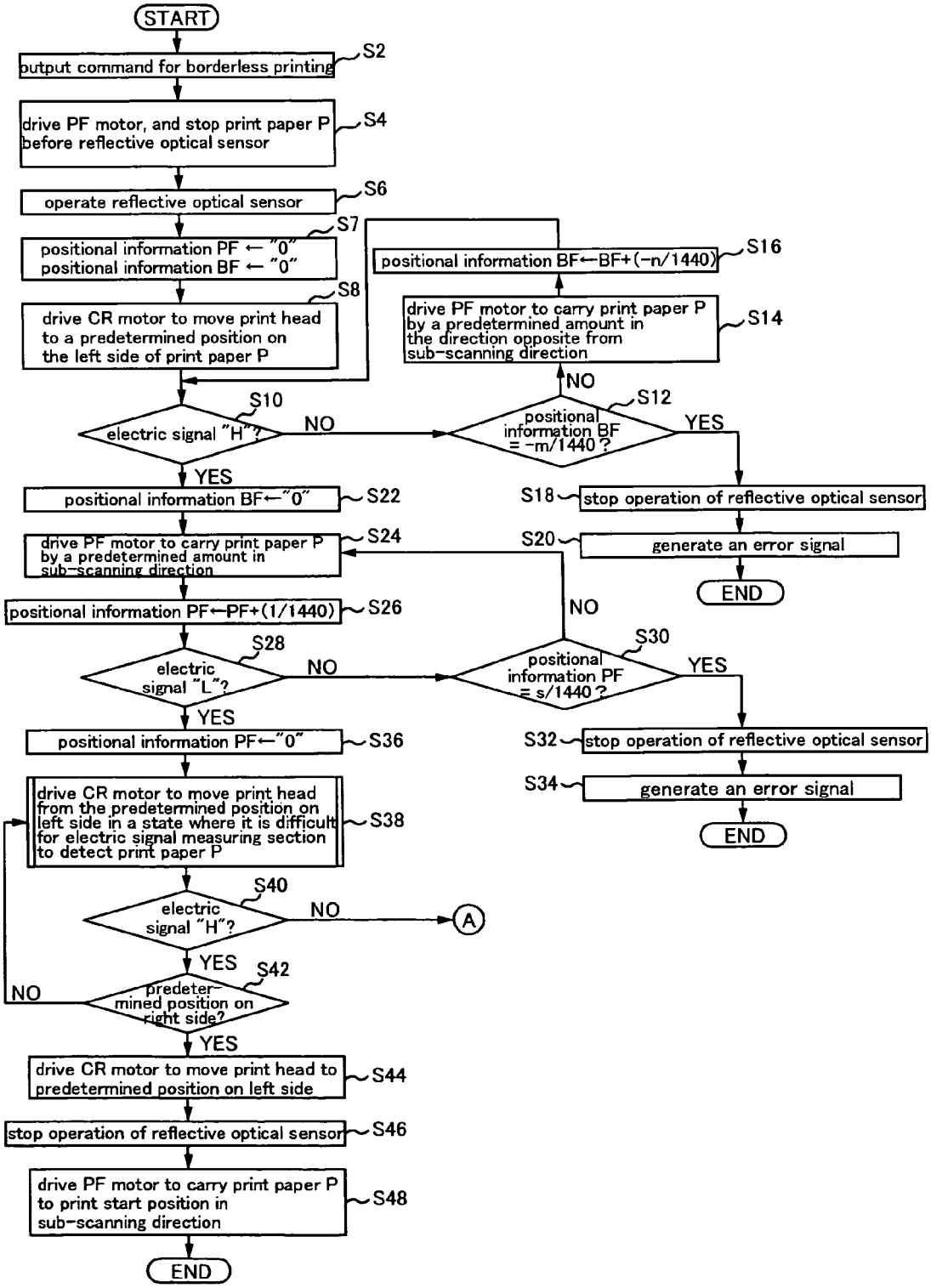
FIG. 9 is a flowchart for describing a printing method of the present embodiment.
Figure 10:
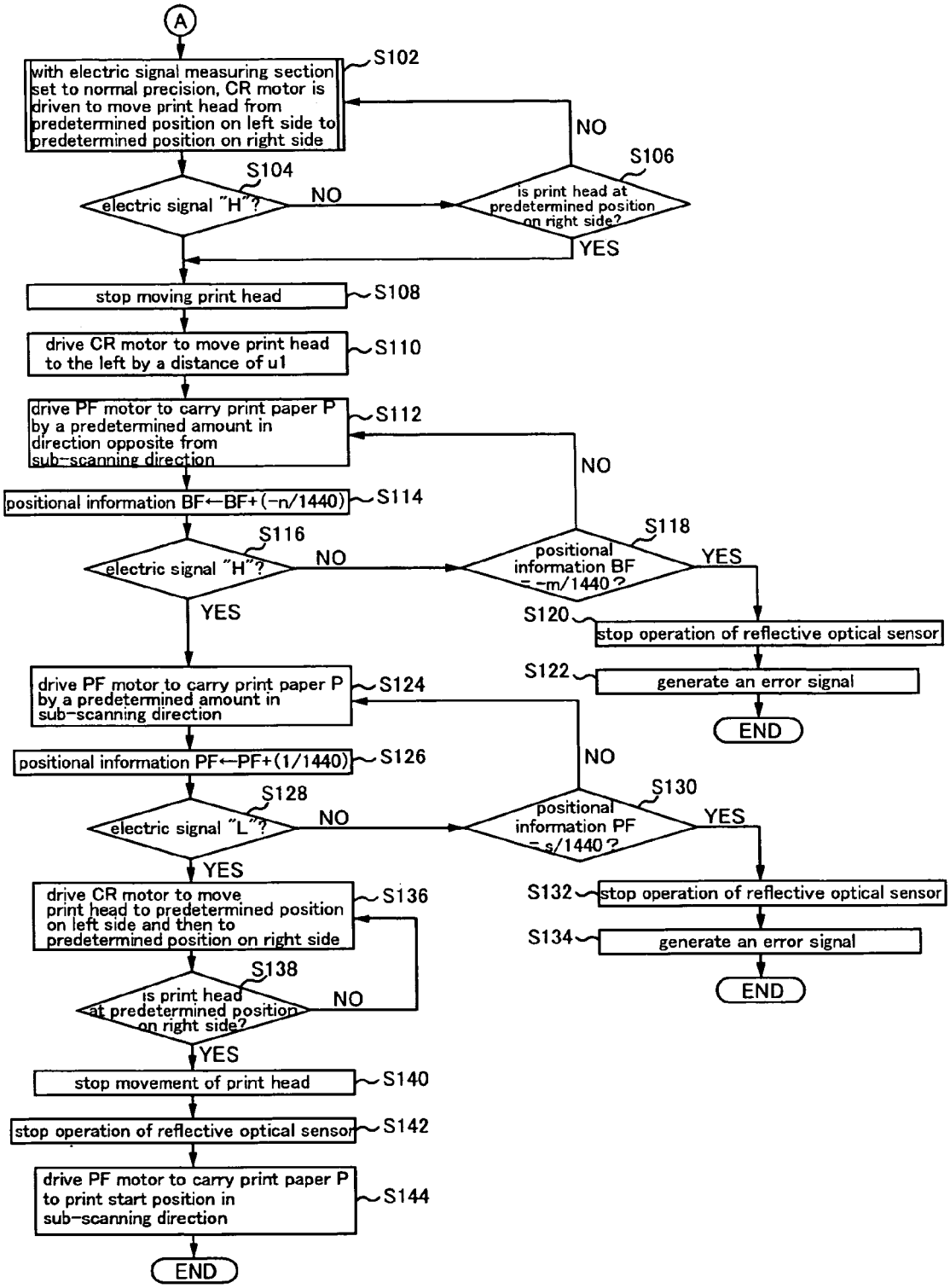
FIG. 10 is a flowchart showing a continuation from FIG. 9.
Figure 11:
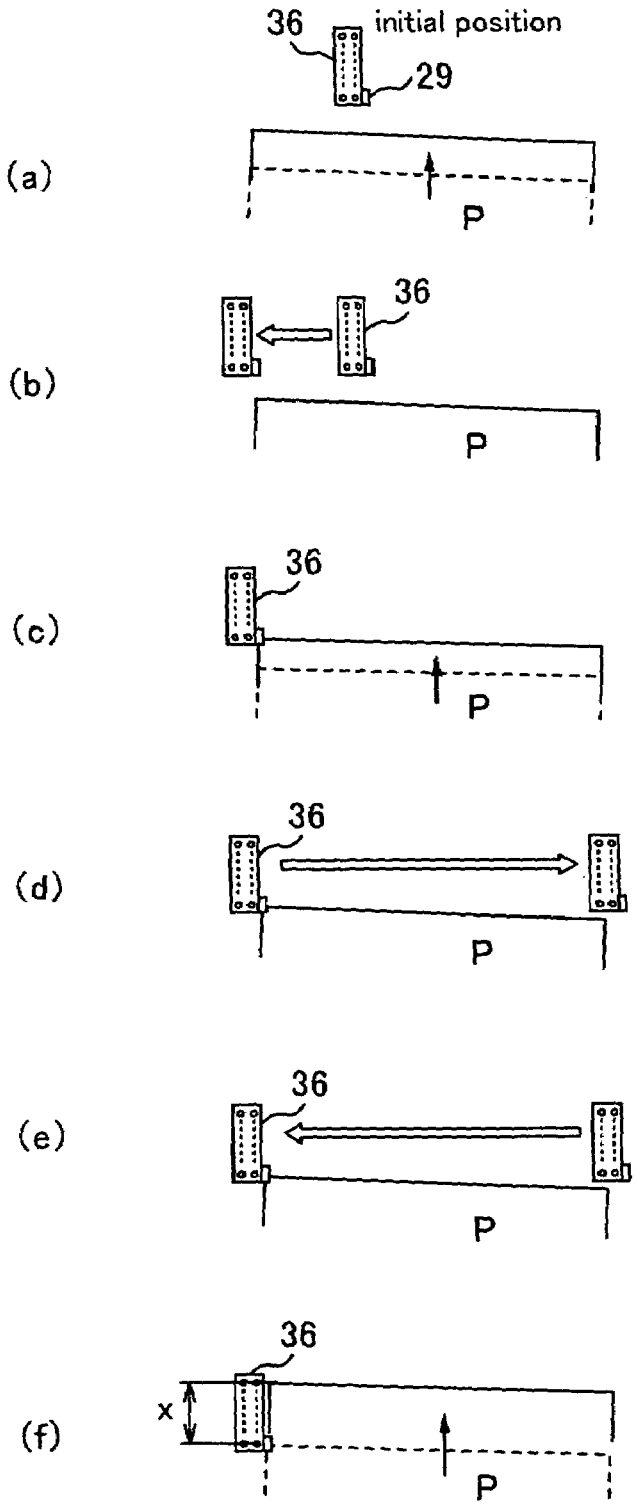
FIGS. 11(*a*)-11(*f*) are schematic diagrams for describing the positional relationship between the print head 36, the reflective optical sensor 29, and the print paper P when the upper left end, in the sub-scanning direction, of the print paper P leads the upper right end.
Figure 12:
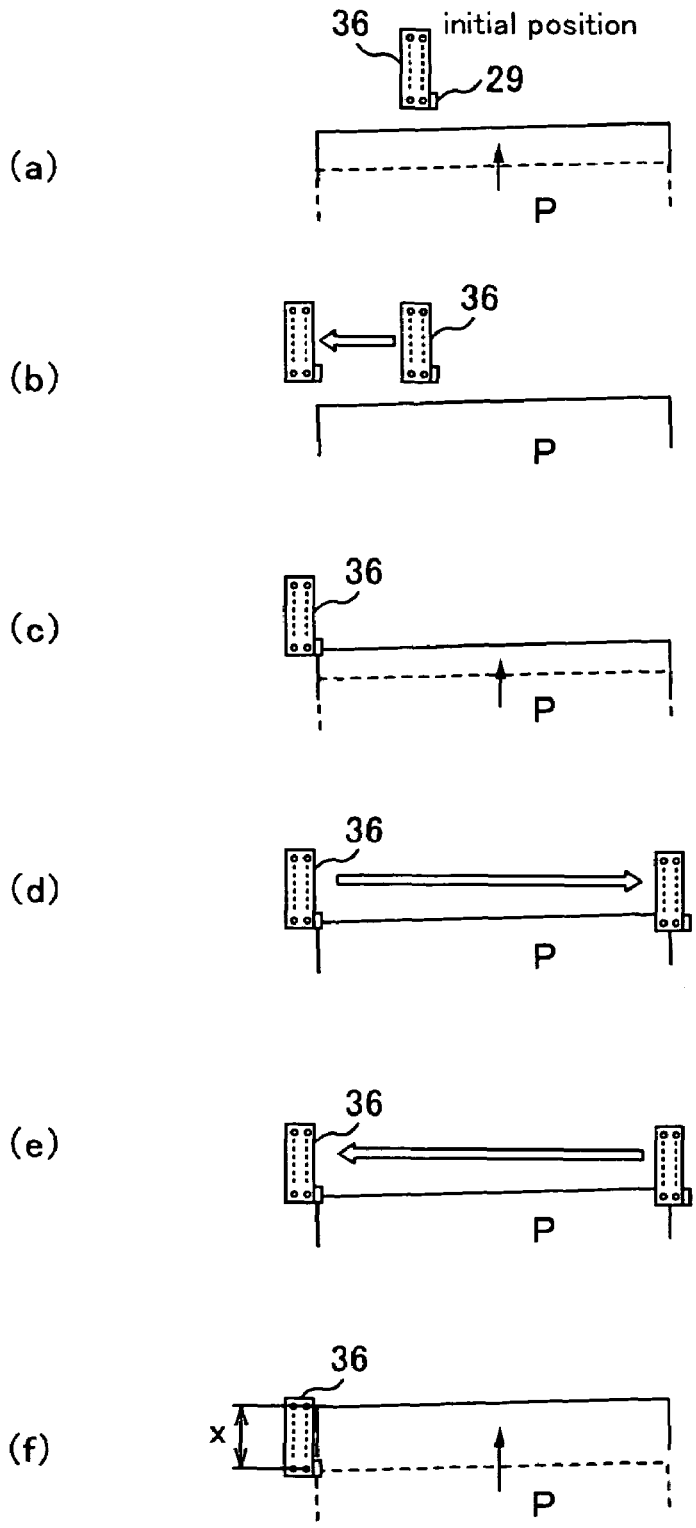
FIGS. 12(*a*)-12(*f*) are schematic diagrams for describing the positional relationship between the print head 36, the reflective optical sensor 29, and the print paper P when the upper right end, in the sub-scanning direction, of the print paper P leads the upper left end by less than a distance h.
Figure 13:
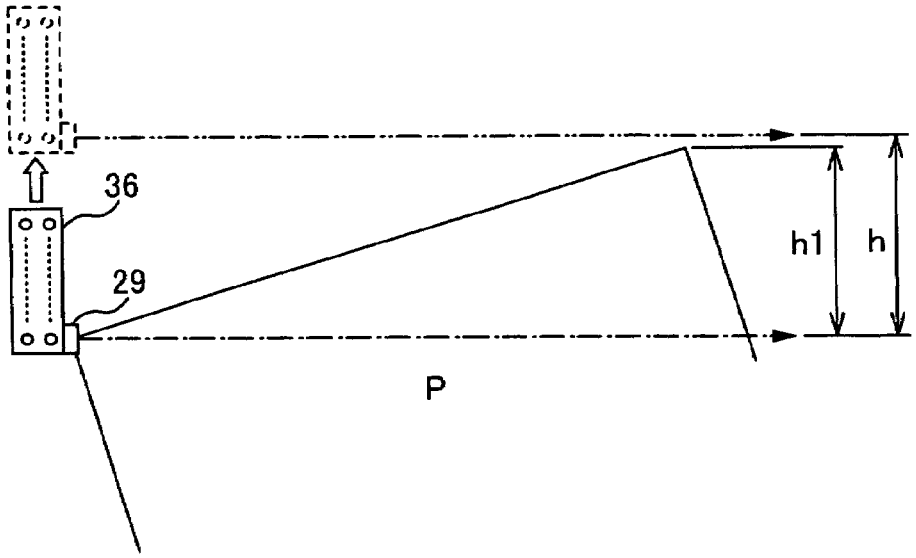
FIGS. 13(*a*) and 13(*b*) are schematic diagrams for describing FIG. 12(*d*) in detail.
Figure 13:
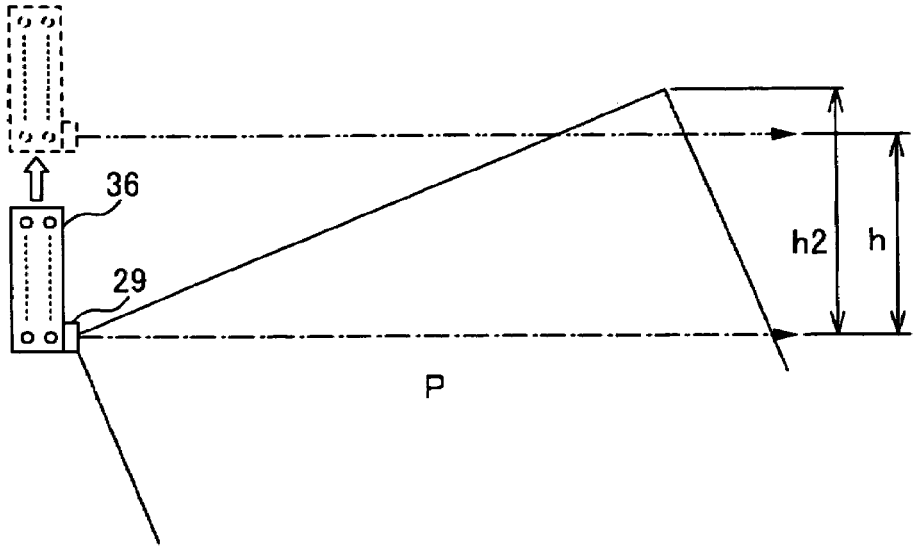
Figure 14:
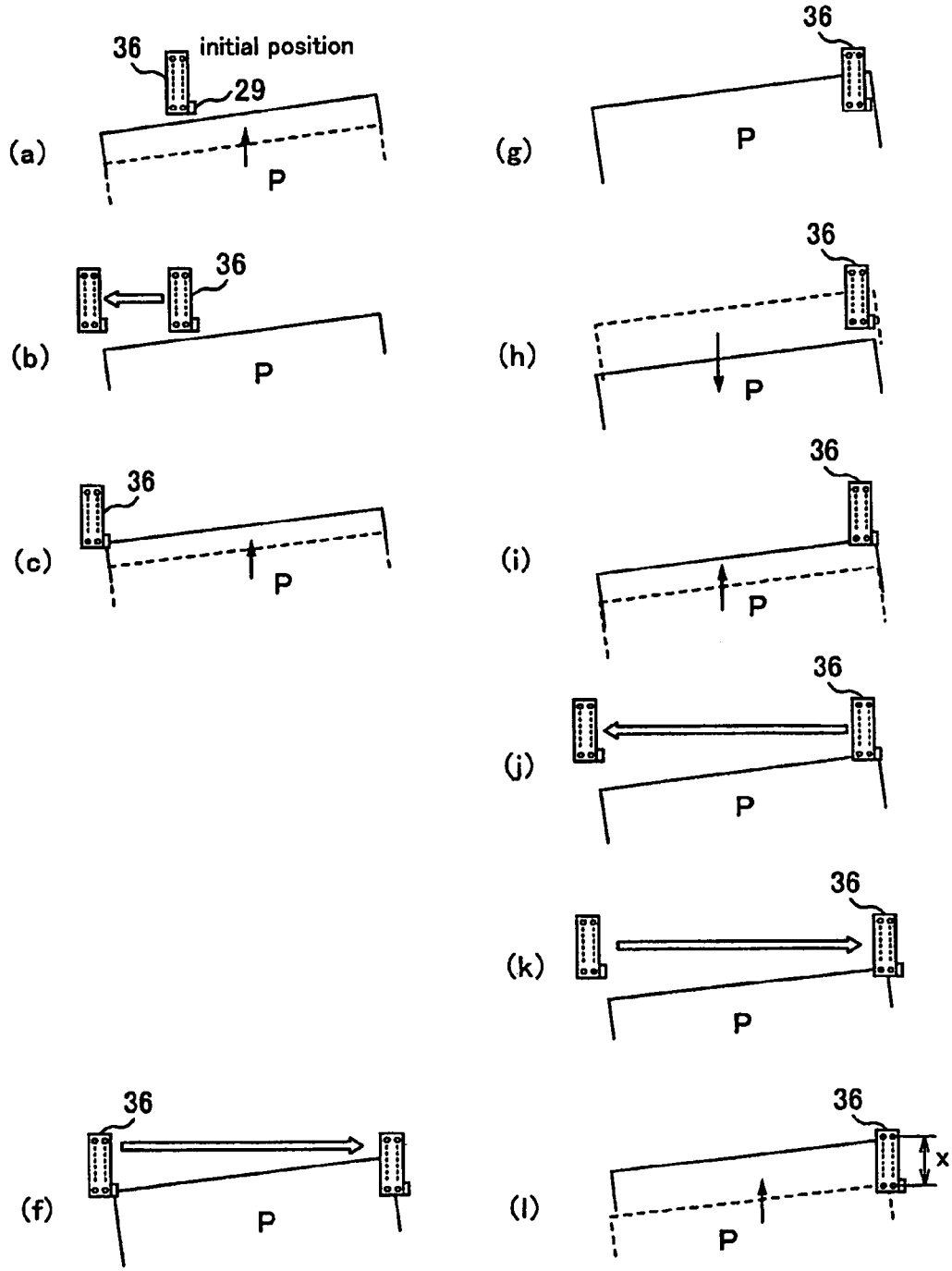
FIGS. 14(*a*)-14(*l*) are schematic diagrams for describing the positional relationship between the print head 36, the reflective optical sensor 29, and the print paper P when the upper right end, in the sub-scanning direction, of the print paper P leads the upper left end by at least a distance h.
Figure 15:
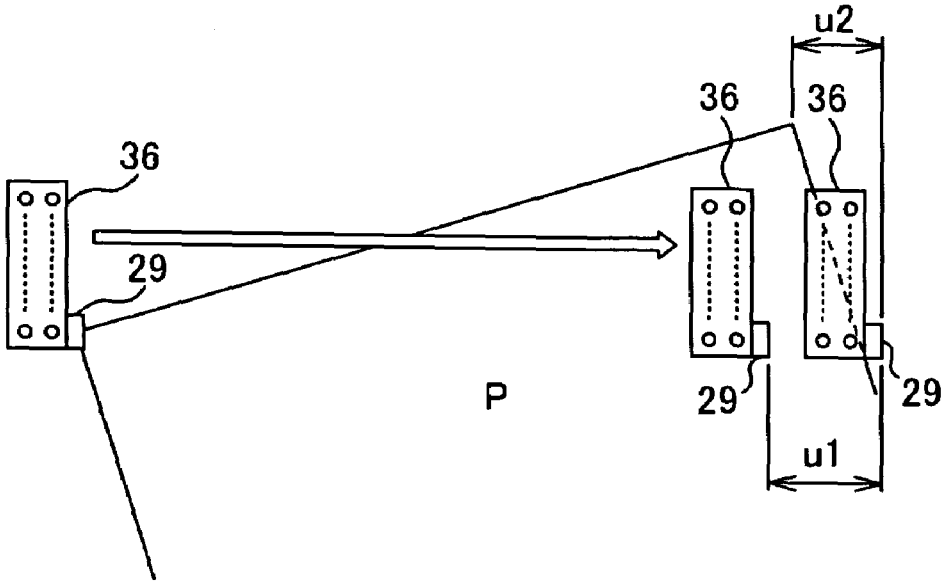
FIG. 15 is a schematic diagram for describing FIGS. 14(*f*) and (*g*) in detail.

Next, a printing method of the present embodiment will be described using FIG. 9, FIG. 10, FIG. 11, FIG. 12, FIG. 13, FIG. 14, and FIG. 15. FIGS. 9 and 10 are flowcharts for describing a printing method of the present embodiment. FIG. 11 is a schematic diagram for describing the positional relationship of the print head 36, the reflective optical sensor 29, and the print paper P when the upper left edge, in the sub-scanning direction, of the print paper P leads the upper right edge. FIG. 12 is a schematic diagram for describing the positional relationship between the print head 36, the reflective optical sensor 29, and the print paper P when the upper right end, in the sub-scanning direction, of the print paper P leads the upper left end by a distance less than h. FIG. 13 is a schematic diagram for describing FIG. 12(*d*) in detail. FIG. 14 is a schematic diagram for describing the positional relationship between the print head 36, the reflective optical sensor 29, and the print paper P when the upper right end, in the sub-scanning direction, of the print paper P leads the upper left end by a distance equal to or greater than h. FIG. 15 is a schematic diagram for describing FIGS. 14(*f*) and (*g*) in detail. It should be noted that in FIG. 11 to FIG. 15, the white circles on the upper side in the paper plane of the print head 36 indicate the black nozzle #1 and the yellow nozzle #1, and the white circles on the lower side in the paper plane of the print head 36 indicate the black nozzle #180 and the cyan nozzle #60. Furthermore, when printing is performed, the print paper P is carried in the sub-scanning direction from the side of the black nozzle #180 and the cyan nozzle #60 shown in FIG. 8, and the reflective optical sensor 29 is arranged beside a predetermined nozzle (for instance, black nozzle #180) in the main-scanning direction.

First, when the power is turned on, the system controller 54 supplies control signals for initialization to the main-scan drive circuit 61, the sub-scan drive circuit 62, and the head drive circuit 63 in accordance with the results of the decoding of initialization program data that are read from the main memory 56. In this way, the drive force of the CR motor 30 is conveyed to the carriage 28, then stopping it so that the print head 36 stops at an initial position (see FIG. 11(*a*) and FIG. 12(*a*)).

If the application program 95 receives an instruction for borderless printing of a specified image from a user while the print head 36 is stopped at the initial position, then the application program 95 outputs a print command for borderless printing of the specified image to control the video driver 91 and the printer driver 96. By doing this, the printer driver 96 receives image data specified by the user from the application program 95, and these data are supplied to the color inkjet printer 20 in the form of print data PD and various commands COM. In accordance with the print data PD and the various commands COM, the color inkjet printer 20 supplies control signals for borderless printing to the main-scan drive circuit 61, the sub-scan drive circuit 62, the head drive circuit 63, and the reflective optical sensor control circuit 65, thus executing the following sequence (S2).

The sub-scan drive circuit 62 drives the PF motor 31 so that the print paper P stops before the stop position of the reflective optical sensor 29 in the sub-scanning direction. By doing this, the print paper P stops at a position where it does not receive the light irradiated from the reflective optical sensor 29 (see FIG. 11(*a*) and FIG. 12(*a*)). It should be noted that the rotation amount of the PF motor 31 is set so that the print paper P does not receive the light irradiated from the reflective optical sensor 29 even assuming a maximum skew of the upper edge, in the sub-scanning direction, of the print paper P (S4).

The reflective optical sensor control circuit 65 puts the reflective optical sensor 29 into the operative state. That is, it is set into an operative state where the light-emitting member 38 emits light and the light-receiving member 40 receives the light emitted from the light-emitting member 38 and converts it into electric signals (S6).

In order to determine the position of the upper edge of the print paper P when the print paper P is stopped before the reflective optical sensor 29 in step S4, the system controller 54 writes to the RAM 57 a "0", as position information PF of the upper edge of the print paper P for when the print paper P is carried in the sub-scanning direction, and writes to a separate address of the RAM 57 a "0", as position information BF of the upper edge of the print paper P for when the print paper P is carried in the direction opposite from the sub-scanning direction (S7).

The main-scan drive circuit 61 drives the CR motor 30 so that the print head 36 stops at a predetermined position on the left edge side of the print paper P in the main-scanning direction. In this way, the print head 36 moves from the initial position up to the predetermined position and stops (see FIG. 11(*b*) and FIG. 12(*b*)). It should be noted that the predetermined position of the left edge of the print paper P is a position slightly to the left from the left edge of the print paper P (S8).

The electric signal measuring section 66 of the reflective optical sensor control circuit 65 measures the intensity of the electric signal obtained from the light-receiving member 40 when the print head 36 is stopped at the predetermined position on the left edge of the print paper P. The measurement result obtained from the electric signal measuring section 66 is supplied to the system controller 54. It should be noted that, as for the measurement result obtained from the electric signal measuring section 66, the internal logic of the electric signal measuring section 66 is configured so that at normal measurement accuracy, the intensity of the electric signal when light is emitted onto the platen 26 is the logic value "H", and the intensity of the electric signal when light is emitted onto the print paper P is the logic value "L" (S10).

When the measurement result obtained from the electric signal measuring section 66 is the logic value "L" (S10: NO), the system controller 54 supplies to the sub-scan drive circuit 62 a control signal for step-driving the PF motor 31.

The sub-scan drive circuit 62 drives the PF motor 31 so that the print paper P is carried in units of a predetermined amount in the direction opposite from the sub-scanning direction. It should be noted that the predetermined amount at this time is an integer multiple n (n is an integer of 1 or greater) of the smallest dot pitch in the sub-scanning direction. For example, when the resolution is 1440 dpi, the predetermined amount is n/1440 inch. In this way, the print paper P is carried by the predetermined amount in the direction opposite from the sub-scanning direction (S14).

Based on the fact that the print paper P was carried by the predetermined amount (for instance, n/1440 inch) in the direction opposite from the sub-scanning direction, the system controller 54 writes the position information BF of the upper edge of the print paper P as "0−n/1440"="−n/1440" to the RAM 57. That is, theoretically, the print paper P is successively carried in the direction opposite from the sub-scanning direction from the stop position of step S4 in units of n/1440 inch (S16).

When the print paper P is carried in the direction opposite from the sub-scanning direction in steps S14 and S16, the electric signal measuring section 66 of the reflective optical sensor control circuit 65 once again measures the intensity of the electric signal obtained from the light-receiving member 40 when the print head 36 is stopped at the predetermined position of the left edge of the print paper P. If the measurement result obtained at this time by the electric signal measuring section 66 is the logic value "L", then the system controller 54 determines whether or not the position information BF of the upper edge of the print paper P in the RAM 57 has reached "−m/1440" (S12).

If the position information BF of the upper edge of the print paper P in the RAM 57 has not reached "−m/1440" (m>n) (S12: NO), then the procedure is once again executed from step S14, but if the position information BF of the upper edge of the print paper P in the RAM 57 has reached "−m/1440" (S12: YES), then the system controller 54 determines that the print paper P has become, for example, jammed because of failure in the carrying mechanism, due to the fact that the light is still being irradiated on the print paper P even though the print paper P should have been carried in the direction opposite from the sub-scanning direction by m/1440 inches from the stop position of step S4. Thus, the reflective optical sensor control circuit 65 sets the reflective optical sensor 29 to a stopped state in which light emission and light reception are not performed (S18). Moreover, the system controller 54 supplies an error signal for alerting the user that the carrying mechanism for the print paper P has failed to, for example, display devices and speakers, which are not shown, of the color inkjet printer 20, thereby ending a series of processes (S20).

In step S10, the system controller 54 determines that light is emitted onto the platen 26 when the measurement result obtained from the electric signal measuring section 66 is the logic value "H" (S10: YES). At this time, "0" is written again (S22) only if steps S14 and S16 have been executed and the position information BF of the upper edge of the print paper P in the RAM 57 has been rewritten.

Then, the system controller 54 supplies a control signal for step-driving the PF motor 31 to the sub-scan drive circuit 62. The sub-scan drive circuit 62 drives the PF motor 31 so that the print paper P is carried in the sub-scanning direction in units of a predetermined amount. It should be noted that the predetermined amount at this time is the smallest dot pitch in the sub-scanning direction. For example, when the resolution is 1440 dpi, the predetermined amount is 1/1440 inch (approx. 17.65 μm). In this way, the print paper P is carried by the predetermined amount in the sub-scanning direction (S24).

Based on the fact that the print paper P was carried in the sub-scanning direction by the predetermined amount (for instance, 1/1440 inch), the system controller 54 writes the position information PF of the upper edge of the print paper P to the RAM 57 as "0+1/1440"="1/1440". That is, theoretically, the print paper P is successively carried in the sub-scanning direction from the stop position in step S10 in units of 1/1440 inch (S26).

The electric signal measuring section 66 of the reflective optical sensor control circuit 65 again measures the intensity of the electric signal obtained from the light-receiving member 40 for when the print head 36 is stopped at the predetermined position of the left edge of the print paper P. The measurement result obtained by the electric signal measuring section 66 is supplied to the system controller 54. (S28)

If the measurement result obtained by the electric signal measuring section 66 is the logic value "H" (S28: NO), then the system controller 54 determines whether or not the position information PF of the upper edge of the print paper P in the RAM 57 has reached "s/1440" (s>1) on the assumption that light is not being emitted onto the print paper P.

If the position information PF of the upper edge of the print paper P in the RAM 57 has not reached "s/1440" (S30: NO), then the procedure is executed again from step S24, and if the position information PF of the upper edge of the print paper P in the RAM 57 has reached "s/1440" (S30: YES), then the system controller 54 determines either that the amount of light emitted from the light-emitting member 38 is no longer an appropriate amount, or that a failure of the mechanism for carrying the print paper P has occurred and the print paper P can no longer be carried in the sub-scanning direction, due to the fact that the light is being emitted on the platen 26 even though the print paper P should have been carried in the sub-scanning direction by s/1440 inches from the stop position in step S10. In this way, the reflective optical sensor control circuit 65 sets the reflective optical sensor 29 to a stopped state in which light emission and light reception are not performed (S32). Moreover, the system controller 54 supplies an error signal for alerting the user that the amount of light emitted by the light-emitting member 38 is not an appropriate amount, or that the carrying mechanism for the print paper P has failed, to, for example, the display devices and speakers, which are not shown, of the color inkjet printer 20, thereby ending a series of processes (S34).

When the measurement result obtained from the electric signal measuring section 66 is the logic value "L" in step S28 (S28: YES), the system controller 54 determines that light has been irradiated onto the upper left end of the print paper P in the sub-scanning direction. Also, it writes "0" to the RAM 57 as the position information PF of the upper edge of the print paper P (S36).

The system controller 54 supplies a control signal for driving the CR motor 30 to the main-scan drive circuit 61. Also, the system controller 54 supplies to the reflective optical sensor control circuit 65 a control signal that makes it difficult for the electric signal measuring section 66 to detect light irradiated to the print paper P. It should be noted that it is possible to make it difficult for the electric signal measuring section 66 to detect the light irradiated to the print paper P through methods such as reducing the amount of light emitted from the light-emitting member 38, reducing the light receptivity of the light-receiving member 40, and changing the threshold value by which the electric signal measuring section 66 determines that light is emitted onto the print paper P. However, as long as the result is that it becomes difficult for the electric signal measuring section 66 to detect the light irradiated onto the print paper P, methods other than those described above may also be adopted. For example, it is also possible to adopt a method in which the above-described light receptivity and threshold value are retained while the print paper P is carried in the direction opposite from the sub-scanning direction by a predetermined amount (for instance, distance h). In this way, the print head 36 begins to move, in the main-scanning direction, from the predetermined position of the left edge of the print paper P toward a predetermined position of the right edge in conjunction with movement of the carriage 28 (see FIG. 11(*d*) and FIG. 12(*d*)). It should be noted that the predetermined position of the right edge of the print paper P is a position slightly to the left of the right edge of the print paper P. At the same time, while making it difficult for the electric signal measuring section 66 to detect the light irradiated onto the print paper P, it begins measuring the intensity of the electric signal obtained from the light-receiving member 40 (S38). Then, the result of the measurement by the electric signal measuring section 66 is supplied to the system controller 54 (S40).

Specifically, making it difficult for the electric signal measuring section 66 to detect the light irradiated onto the print paper P is equivalent to the print head 36.

For example, in step S38, when the upper right end of the print paper P is leading the upper left end in the sub-scanning direction by a distance h1 (<distance h), the electric signal measuring section 66 continues to output the logic value "H" even if the print head 36 is moved in the main-scanning direction from the predetermined position on the left side to the predetermined position on the right side, and does not detect light being irradiated to the print paper P. In other words, the system controller 54 executes the same process as when the upper left end of the print paper P is leading the upper right end in the sub-scanning direction, assuming that the distance h1 by which the upper right end of the print paper P leads the upper left end in the sub-scanning direction is small and will not affect borderless printing (see FIG. 13(*a*)).

On the other hand, in step S38, when the upper right end, in the sub-scanning direction, of the print paper P is leading the upper left end by a distance h2 (>distance h), the electric signal measuring section 66 outputs the logic value "L" at an intermediate point when the print head 36 has moved in the main-scanning direction from the predetermined position on the left side of the print paper P to the predetermined position on the right side, and light irradiated onto the print paper P is detected. In other words, the system controller 54 executes a different process from when the upper left end of the print paper P is leading the upper right end in the sub-scanning direction, assuming that the distance h2 by which the upper right end of the print paper P leads the upper left end in the sub-scanning direction is large and would affect borderless printing (see FIG. 13(*b*)).

If the measurement result obtained from the electric signal measuring section 66 is the logic value "H" (S40: YES), then the system controller 54 continues the determination of step S40 until the print head 36 moves in the main-scanning direction from the predetermined position on the left side of the print paper P to the predetermined position on the right side (S42).

When the measurement result obtained from the electric signal measuring section 66 is the logic value "H" (S42: YES) from the predetermined position on the left side of the print paper P up to the predetermined position on the right side, the system controller 54 determines the carrying status of the print paper P to be either that the upper left end of the print paper P is leading the upper right end in the sub-scanning direction, or that the upper right end of the print paper P is leading the upper left end by the distance h1 in the sub-scanning direction. Then, the main-scan drive circuit 61 drives the CR motor 30 such that the print head 36 moves from the predetermined position on the right side of the print paper P to the predetermined position on the left side (see FIG. 11(*e*) and FIG. 12(*e*)). In this way, the print head 36 stops at the predetermined position on the left side of the print paper P (S44).

The reflective optical sensor control circuit 65 sets the reflective optical sensor 29 to a stopped state in which light emission and light reception are not performed (S46).

The system controller 54 supplies the sub-scan drive circuit 62 with a control signal for driving the PF motor 31. The sub-scan drive circuit 62 drives the PF motor 31 so that the upper left end of the print paper P is at the foremost position of the print head 36 (position of the black nozzle #1 and the yellow nozzle #1). In this way, the print paper P is carried in the sub-scanning direction by a distance x (=179 kD), which is the distance from #1 to #180 of the black nozzle row K of the print head 36, and the upper left end of the print paper P is positioned on the same line as the foremost position of the print head 36 in the main-scanning direction. In other words, the print start position of the print paper P in the sub-scanning direction is determined (see FIG. 11(*f*) and FIG. 12(*f*)). Then borderless printing of the predetermined image specified by the user is performed. It should be noted that it is also possible to shorten the distance x and eject ink also on the upper side of the upper left end of the print paper P so as to reliably perform borderless printing (S48). It should be noted that it is also possible to omit the above-described step S44 and perform only the first printing movement in the main-scanning direction by moving the print head 36 from the right side of the print paper P to the left side. Also, the carrying distance of the print paper P in FIG. 11(*f*) and FIG. 12(*f*) is not limited to x. For example, depending on the various printing modes, the print paper P may be carried so that the upper left end of the print paper P is positioned at any position on #1 to #180 of the black nozzle row.

Incidentally, when the measurement result obtained from the electric signal measuring section 66 changes to the logic value "L" (S40: NO) at an intermediate point as the print head 36 moves in the main-scanning direction from the predetermined position on the left side of the print paper P to the predetermined position on the right side, the system controller 54 determines that the upper right end of the print paper P is leading the upper left end in the sub-scanning direction by a distance h2 (>distance h), as regards the carrying status of the print paper P. That is, it determines that there is an effect on borderless printing. At this time, the main-scan drive circuit 61 drives the CR motor 30 so that the print head 36 returns to the predetermined position on the left side of the print paper P. In this way, the print head 36 is moved up to the predetermined position on the left side from the above-mentioned intermediate point for when the print head 36 was being moved in the main-scanning direction from the predetermined position on the left side of the print paper P to the predetermined position on the right side, and the print head is then stopped. It should be noted that the print head 36 may instead ascertain the right side edge of the print paper P without moving from the above-mentioned intermediate point to the predetermined position on the left side.

The system controller 54 supplies a control signal for driving the CR motor 30 to the main-scan drive circuit 61. Also, the system controller 54 supplies to the reflective optical sensor control circuit 65 a control signal for the electric signal measuring section 66 to detect light irradiated to the print paper P at the normal measuring accuracy. In this way, the print head 36 begins to move in the main-scanning direction from the predetermined position of the left side of the print paper P toward a predetermined position of the right side in conjunction with movement of the carriage 28 (see FIG. 14(*f*)). At the same time, the electric signal measuring section 66 begins measuring the intensity of the electric signal obtained from the light-receiving member 40 at the normal measuring accuracy. Then, the result of the measurement by the electric signal measuring section 66 is supplied to the system controller 54 (S102).

When the measurement result obtained from the electric signal measuring section 66 is the logic value "L" (S104: NO), the system controller 54 determines that light is irradiated onto the print paper P. Moreover, when the system controller 54 determines that the print head 36 has not moved to the predetermined position on the right side of the print paper P (S106: NO), then the operations of step S102 and step S104 are executed again. That is, when the system controller 54 determines that the result of the measurement by the electric signal measuring section 66 has changed from the logic value "L" to the logic value "H," then it is determined that the print head 36 is positioned at the right side edge of the print paper P on the assumption that movement of the carriage 28 has led to a change from the state where light is irradiated onto the print paper P to a state where light is irradiated onto the platen 26 (see FIG. 15).

When the measurement result obtained from the electric signal measuring section 66 is the logic value "H" (S104: YES), or when the system controller 54 determines that the print head 36 has moved to the predetermined position on the right side of the print paper P (S106: YES), then the main-scan drive circuit 61 stops driving the CR motor 30. In this way, the print head 36 stops at the position of the positive branch of step S104 or step S106 (S108).

The main-scan drive circuit 61 drives the CR motor 30 so that the print head 36 moves in the main-scanning direction to the left from the stop position of the positive branch of step S104 or step S106 by a distance of u1. It should be noted that the distance u1 is longer than a distance u2 in the main-scanning direction between the upper right end of the print paper P and the reflective optical sensor 29 for when the upper right end, in the sub-scanning direction, of the print paper P leads the upper left end by a maximum limit. In this way, the print head 36 moves up to the position where the reflective optical sensor 29 is more to the left, in the main-scanning direction, than the upper right end of the print paper P and stops (see FIG. 14(*g*) and FIG. 15). That is, it becomes possible to later detect the upper edge of the print paper P (S110).

Since the system controller 54 determines that the reflective optical sensor 29 is irradiating light onto the print paper P, the system controller 54 supplies a control signal for driving the PF motor 31 to the sub-scan drive circuit 62. The sub-scan drive circuit 62 drives the PF motor 31 so that the print paper P is carried in the direction opposite from the sub-scanning direction in units of a predetermined amount. It should be noted that the predetermined amount at this time is an integer multiple n (n is an integer of 1 or greater) of the smallest dot pitch in the sub-scanning direction. For example, when the resolution is 1440 dpi, then the predetermined amount is n/1440 inch. In this way, the print paper P is carried by the predetermined amount in the direction opposite from the sub-scanning direction (S112).

Based on the fact that print paper P was carried in the direction opposite from the sub-scanning direction by the predetermined amount (for instance, n/1440 inch), the system controller 54 writes "0−n/1440"="−n/1440" to the RAM 57 as the position information BF of the upper edge of the print paper P. That is, theoretically, the print paper P is successively carried in the direction opposite from the sub-scanning direction from the stop position of step S110 in units of n/1440 inch (S114).

When the print paper P is carried in the direction opposite from the sub-scanning direction in steps S112 and S114, the electric signal measuring section 66 of the reflective optical sensor control circuit 65 measures the intensity of the electric signal obtained from the light-receiving member 40 for when the print head 36 is stopped at the stop position of step S110 (S116). If the measurement result obtained by the electric signal measuring section 66 at this time is the logic value "L" (S116: NO), then the system controller 54 determines whether or not the position information BF of the upper edge of the print paper P in the RAM 57 has reached "−m/1440" (S118).

If the position information BF of the upper edge of the print paper P in the RAM 57 has not reached "−m/1440" (m>n) (S118: NO), then the procedure is once again executed from step S112, but if the position information BF of the upper edge of the print paper P in the RAM 57 has reached "−m/1440" (S118: YES), then the system controller 54 determines that the print paper P has become, for example, jammed because of failure in the mechanism for carrying the print paper P, due to the fact that the light is still being irradiated on the print paper P even though the print paper P should have been carried in the direction opposite from the sub-scanning direction by m/1440 inches from the stop position of step S110. Thus, the reflective optical sensor control circuit 65 sets the reflective optical sensor 29 to a stopped state in which light is not emitted or received (S120). Moreover, the system controller 54 supplies an error signal for alerting the user that the carrying mechanism for the print paper P has failed to, for example, the display devices and speakers, which are not shown, of the color inkjet printer 20, thereby ending a series of processes (S122).

In step S116, the system controller 54 determines that the reflective optical sensor 29 emits light onto the platen 26 when the measurement result obtained from the electric signal measuring section 66 is the logic value "H" (S116: YES) (see FIG. 14(*h*)).

Then, the system controller 54 supplies a control signal for step-driving the PF motor 31 to the sub-scan drive circuit 62. The sub-scan drive circuit 62 drives the PF motor 31 so that the print paper P is carried in the sub-scanning direction in units of a predetermined amount. It should be noted that the predetermined amount at this time is the smallest dot pitch in the sub-scanning direction. For example, when the resolution is 1440 dpi, the predetermined amount is $1/1440$ inch (approx. 17.65 μm). Thus, the print paper P is carried in the sub-scanning direction by the predetermined amount (S124).

Based on the fact that the print paper P was carried in the sub-scanning direction by the predetermined amount (for instance, $1/1440$ inch), the system controller 54 writes "$0+1/1440$"="$1/1440$" to the RAM 57 as the position information PF of the upper edge of the print paper P. That is, theoretically, the print paper P is successively carried in the sub-scanning direction from the stop position of the positive branch of step S116 in units of $1/1440$ inch (S126).

The electric signal measuring section 66 of the reflective optical sensor control circuit 65 again measures the intensity of the electric signal obtained from the light-receiving member 40 for when the print head 36 is stopped at the predetermined position of step S110. The measurement result obtained by the electric signal measuring section 66 is supplied to the system controller 54. (S128)

When the measurement result obtained from the electric signal measuring section 66 at this time is the logic value "H" (S128: NO), then the system controller 54 determines whether or not the position information PF of the upper edge of the print paper P in the RAM 57 has reached "s/1440" (s>1) on the assumption that light is not emitted onto the print paper P (S130).

When the position information PF of the upper edge of the print paper P in the RAM 57 has not reached "s/1440" (S130: NO), then the procedure is executed again from step S124, and when the position information PF of the upper edge of the print paper P in the RAM 57 has reached "s/1440", (S130: YES), then the system controller 54 determines either that the amount of light emitted from the light-emitting member 38 is no longer an appropriate amount, or that a failure of the mechanism for carrying the print paper P has occurred and the print paper P can no longer be carried in the sub-scanning direction, due to the fact that the light is being emitted on the platen 26 even though the print paper P should have been carried in the sub-scanning direction by s/1440 inches from the stop position of the positive branch of step S116. Thus, the reflective optical sensor control circuit 65 sets the reflective optical sensor 29 to a stopped state in which it does not emit or receive light (S132). Moreover, the system controller 54 supplies an error signal for alerting the user that either the amount of light emitted by the light-emitting member 38 is not an appropriate amount, or that the carrying mechanism for the print paper P has failed to, for example, the display devices and speakers, which are not shown, of the color inkjet printer 20, thereby ending a series of processes (S134).

When the measurement result obtained by the electric signal measuring section 66 is the logic value "L" in step S128 (S128: YES), the system controller 54 determines that light is being irradiated onto the upper right end, in the sub-scanning direction, of the print paper P (see FIG. 14(*i*)).

The system controller 54 supplies a control signal for driving the CR motor 30 to the main-scan drive circuit 61. Thus, the print head 36 moves in the main-scanning direction from the stopped position of step S110 up to a predetermined position of the left side of the print paper P, then moves from the predetermined position of the left side on the print paper P to the predetermined position on the right side, and then stops (see FIGS. 14(*i*) and (*k*)). That is, the print start position of the print head 36 in the main-scanning direction is determined (S136, S138). It should be noted that the print head 36 does not have to return to the predetermined position on the right side.

The main-scan drive circuit 61 stops driving the CR motor 30 (S140). Also, the reflective optical sensor control circuit 65 sets the reflective optical sensor 29 to a stopped state in which it does not emit or receive light (S142).

The system controller 54 supplies a control signal for driving the PF motor 31 to the sub-scan drive circuit 62. The sub-scan drive circuit 62 drives the PF motor 31 so that the upper right end of the print paper P is at the foremost position of the print head 36 (position of the black nozzle #1 and the yellow nozzle #1). In this way, the print paper P is carried in the sub-scanning direction by a distance x (=179 kD), which is a distance from #1 to #180 of the black nozzle row K of the print head 36, and the upper right end of the print paper P is positioned on the same line as the foremost position of the print head 36 in the main-scanning direction. That is, the print start position of the print paper P in the sub-scanning direction is determined (see FIG. 14(*l*)). Then, borderless printing of the predetermined image specified by the user is performed. It should be noted that it is also possible to shorten the distance x and eject ink starting from the upper side of the upper left end of the print paper P so as to reliably perform borderless printing (S144). It should be noted that the carrying distance of the print paper P in FIG. 14(*l*) is not limited to x. For example, depending on the various printing modes, the print paper P may be carried so that the upper right end of the print paper P is positioned at any position on #1 to #180 of the black nozzle row.

Incidentally, if either the upper right end or the upper left end of the print paper P is carried leading the other in a printing apparatus for carrying print paper P in a sub-scanning direction that intersects the main-scanning direction of the print head 36, then the actual print start position on the print paper P deviates from the anticipated print start position, and this is not preferable. In particular, in the case of performing borderless printing, then there is a possibility that the print paper P may be rendered useless when blank areas are left on the upper edge of the print paper P due to the skew in the carrying direction of the print paper P. On the other hand, when performing borderless printing, an increase in the margin of the print range in order to cover the entire print paper P reduces the possibility that a blank area will be formed at the upper edge of the print paper P; however, there is a possibility that the amount of ink consumed will increase.

In view of the above, the apparatus is configured such that, when an upper end, of among the upper right end or the upper left end of the print paper P, that is on the side where the reflective optical sensor 29 is positioned is leading the other at the detection position, the print paper P is carried from that detection position in the predetermined direction by a predetermined amount. On the other hand, only when an upper end, of among the upper right end or the upper left end of the print paper P, that is on the side opposite from the side where the reflective optical sensor 29 is positioned is leading the other by at least a set amount at the detection position, then the reflective optical sensor 29 is positioned from the one side to the other side, the print paper P is carried from the detection position in the direction opposite from the predetermined direction, then the print paper P is carried in the predetermined direction up to the detection position where the electric signal measuring section 66 detects the print paper P, and then the print paper P is carried in the predetermined direction from the detection position by a predetermined amount. By doing this, the print start position, in the predetermined direction, of the print paper P can be determined very accurately and efficiently, and formation of blank areas at the upper edge of the print paper P and an increase in the ink-consumption amount upon borderless printing are eliminated.

Further, when the upper end, among the upper right end and the upper left end of the print paper P, that is on the side opposite from the side where the reflective optical sensor 29 is positioned is leading the other by less than the set amount at the detection position, the print paper P may be carried in the predetermined direction from the detection position by the predetermined amount.

In this way, the print paper P is carried as it is from the detection position in the predetermined direction by the predetermined amount in a case where the upper end, among the upper right end and the upper left end of the print paper P, that is on the side opposite from the side where the reflective optical sensor 29 is positioned is leading the other only by an amount that is less than the set amount at the detection position. Thus, the print start position, in the predetermined direction, of the print paper P can be determined very accurately and efficiently.

Further, this apparatus may be provided with a print head 36 for printing on the print paper P by ejecting ink as the print head moves in a main-scanning direction that intersects the carrying direction in which the print paper P is carried.

In this way, the print start position, in the predetermined direction, of the print paper 36 can be determined very accurately and efficiently in cases where there is a print head 36 that can move in a main-scanning direction that intersects the carrying direction in which the print paper P is carried.

Further, the reflective optical sensor 29 may be provided together with the print head 36 in/on a carriage 28 for moving in the main-scanning direction.

In this way, the print start position, in the predetermined direction, of the print paper P can be determined very accurately and efficiently using the reflective optical sensor 29 that is provided together with the print head 36 in/on the carriage 28.

Further, the upper end, among the upper right end and the upper left end of the print paper P, that is leading the other at the detection position may be found by detecting whether or not the print paper P is present by moving the reflective optical sensor 29 from the one side to the other side in the movement direction after carrying the print paper P in the predetermined direction up to the detection position where the reflective optical sensor 29 positioned on the one side in the movement direction detects the print paper P.

In this way, it is possible to determine the print start position, in a predetermined direction, of the print paper P very accurately and efficiently using the reflective optical sensor 29 for detecting whether or not the print paper P is present by moving from one side to the other side in a movement direction after the print paper P is carried in the predetermined direction up to the detection position where the reflective optical sensor 29 positioned on the one side in the movement direction detects the print paper P.

Further, it may be made difficult for the reflective optical sensor 29 to detect the print paper P when the reflective optical sensor 29 is moved from the one side to the other side in the movement direction.

In this way, by making it difficult for the reflective optical sensor 29 to detect the print paper P, the print paper P is kept from being carried in the direction opposite from the predetermined direction if the upper end, among the upper right end and the upper left end of the print paper P, that is on the side opposite from the side where the reflective optical sensor 29 is positioned is leading by less than a set amount. Thus, it is possible to determine the print start position, in the predetermined direction, of the print paper P more efficiently.

Further, in the process of moving the reflective optical sensor 29 from the one side to the other side in the movement direction, if the reflective optical sensor 29 does not detect the print paper P, then it is assumed that the upper end, among the upper right end and the upper left end of the print paper P, that is on the one side in the movement direction of the reflective optical sensor 29 is leading the other at the detection position, or that the upper end, among the upper right end and the upper left end of the print paper P, that is on the other side in the movement direction of the reflective optical sensor 29 is leading the other by less than the set amount; and if the reflective optical sensor 29 detects the print paper P, then it is assumed that the upper end, among the upper right end and the upper left end of the print paper P, that is on the other side in the movement direction of the reflective optical sensor 29 is leading by at least the set amount.

In this way, when the reflective optical sensor 29 does not detect the print paper P, then it is assumed that the upper end, among the upper right end and the upper left end of the print paper P, that is on the one side in the movement direction of the reflective optical sensor 29 is leading the other at the detection position, or that the upper end, among the upper right end and the upper left end of the print paper P, that is on the other side in the movement direction of the reflective optical sensor 29 is leading the other only by an amount that is less than the set amount. Thus, the print paper P is kept from being carried in the direction opposite from the predetermined direction, allowing the print start position, in the predetermined direction, of the print paper P to be determined more efficiently.

Further, the reflective optical sensor 29 may have a light-emitting member 38 for emitting light and a light-receiving member 40 for receiving the light that is emitted by the light-emitting member 38, and may detect the print paper P based on an output value of the light-receiving member 40.

In this way, the print start position, in the predetermined direction, of the print paper P can be determined very accurately and efficiently using the reflective optical sensor 29, which includes a light-emitting member 38 and a light-receiving member 40.

Further, the print head 36 may perform printing with respect to an entire surface of the print paper P.

In this way, it is possible to determine the print start position, in the predetermined direction, of the medium to be printed very accurately and efficiently in cases where printing is carried out with respect to the entire surface of the medium to be printed.

===Other Embodiments===

A print apparatus, a printing method, a program, and a computer system according to the present invention were described above according to an embodiment thereof. However, the foregoing embodiment of the invention is for the purpose of elucidating the present invention and is not to be interpreted as limiting the present invention. The invention can of course be altered and improved without departing from the gist thereof and includes equivalents.

In the initial state of the color inkjet printer 20, it is also possible to position the reflective optical sensor 29 on the one side in the movement direction. This allows the operation for determining the print start position, in the sub-scanning direction, of the print paper P to be simplified. It is also possible to carry the print paper P in the sub-scanning direction while moving the reflective optical sensor 29 in the main-scanning direction, so as to detect the upper edge of the print paper P.

In the foregoing embodiment, the print paper P was adopted as the medium to be printed, but this is not a limitation. That is, in the present invention, it is also possible to adopt film, cloth, or thin metal plates, for example, as the medium to be printed.

It is also possible to provide the color inkjet printer 20 with some of the functions or mechanisms of a main computer unit, a display device, an input device, a flexible disk drive device, and a CD-ROM drive device. For example, it is possible to adopt a configuration in which the color inkjet printer 20 is provided with an image processing section for carrying out image processing, a display section for carrying out various types of displays, and a recording media attachment/detachment section to and from which recording media storing image data captured by a digital camera or the like are inserted and taken out.

In the foregoing embodiment, a color inkjet printer 20 was adopted, but this is not a limitation. That is, the present invention can be adopted for monochrome inkjet printers and non-inkjet type printers, for example, as well. Moreover, the present invention can be adopted for printing apparatuses such as facsimile devices and copy machines.

In the foregoing embodiment, the light-emitting member 38 and the light-receiving member 40 were both provided in the carriage 28 along with the print head 36, but this is not a limitation. That is, it is also possible to adopt a configuration in which the light-emitting member 38 and the light-receiving member 40 are separate of the carriage 28 and can move in synchronization with one other in the main-scanning direction. Also, the light-emitting member 38 and the light-receiving member 40 are not limited to a reflective optical sensor, and may also be a transmission-type optical sensor in which the medium to be printed is in the light path, a line sensor, or an area sensor, for example.

INDUSTRIAL APPLICABILITY

According to the present invention, the print start position, in a predetermined direction, of a medium to be printed can be determined with high precision and efficiency.

The invention claimed is:

1. A printing apparatus comprising:

a detection section that is capable of moving and that is for detecting a medium to be printed;

a transporting section for transporting the medium to be printed in a direction that intersects a movement direction of said detection section; and a control section, wherein the control section first causes said detection section to be positioned on one side in said movement direction, then causes said transporting section to transport said medium to be printed in a predetermined direction up to a first detection position where said detection section detects a first upper end of said medium to be printed, and then causes said detection section to move from the one side to the other side that is opposite from the one side in said movement direction, where said detection section detects a second upper end of said medium to be printed, wherein if said detection section detects that said second upper end is leading said first upper end by at least a set amount at said first detection position, said control section causes said transporting section to transport said medium to be printed from said detection position in a direction opposite from said predetermined direction, then causes said medium to be printed to be transported in said predetermined direction up to a second detection position where said detection section detects said medium to be printed, and then causes said medium to be printed to be transported by a predetermined amount in said predetermined direction from said second detection position; and wherein if said detection detects that said first upper end is leading said second upper end, said control section causes said transporting section to transport said medium to be printed in said predetermined direction from said first detection position by said predetermined amount without causing said transporting section to transport said medium to be printed from said first detection position in the direction opposite from said predetermined direction.

2. A printing apparatus according to claim 1, wherein when said second upper end is leading said first upper end by less than said set amount at said first detection position, said control section causes said transporting section to transport said medium to be printed in said predetermined direction from said first detection position by said predetermined amount.

3. A printing apparatus according to claim 1, further comprising:

a print head for printing on said medium to be printed by ejecting ink as said print head moves in a main-scanning direction that intersects the transporting direction in which said medium to be printed is carried transported.

4. A printing apparatus according to claim 3, wherein said detection section is provided together with said print head in/on a moving member for moving in said main-scanning direction.

5. A printing apparatus according to claim 1, wherein the control section determines the leading end among the first upper end and the second upper by detecting whether or not each said upper end is detected after causing said transporting section to transport said medium to be printed to said first detection position.

6. A printing apparatus according to claim 5, wherein if said detection section does not detect said medium to be printed after the detection section is moved, then it is assumed that said first upper end is leading at said first detection position, or that said second upper end is leading by less than the set amount, and if said detection section detects said medium to be printed after the detection section is moved, then it is assumed that said second upper end is leading by at least the set amount.

7. A printing apparatus according to claim 1, wherein said detection section has a light-emitting member for emitting light and a light-receiving member for receiving the light that is emitted by said light-emitting member, and detects said medium to be printed based on an output value of said light-receiving member.

8. A printing apparatus according to claim 3, wherein said print head performs printing with respect to an entire surface of said medium to be printed.

9. A printing method for a printing apparatus provided with a sensor that is capable of moving and that is for detecting a medium to be printed, and a transport roller for transporting the medium to be printed in a direction that intersects a movement direction of said sensor, said printing method comprising:

first causing said sensor to be positioned on one side in said movement direction;

then causing said transport roller to transport said medium to be printed in a predetermined direction up to a first direction position where said sensor detects a first upper end of said medium to be printed; and then causing said sensor to move from the one side to the other side that is opposite from the one side in said movement direction, where said sensor detects a second upper end of said medium to be printed, and wherein if said sensor detects that said second upper end is leading said first upper end by at least a set amount at said first detection position, causing said transport roller to transport said medium to be printed from said first detection position in a direction opposite from said predetermined direction, then causing said transport roller to transport said medium to be printed in said predetermined direction up to a second detection position where said sensor detects said medium to be printed, and then causing said transport roller to transport said medium to be printed by a predetermined amount in said predetermined direction from said second detection position, and wherein if said detection section detects that said first upper end is leading said second upper end, causing said transport roller to transport said medium to be printed in said predetermined direction from said first detection position by said predetermined amount without causing said transport roller to transport said medium to be printed from said first detection position in the direction opposite from said predetermined direction.

10. A computer readable storage medium which stores program instructions for causing a printing apparatus, provided with a detection section that is capable of moving and that is for detecting a medium to be printed and a transporting section for transporting the medium to be printed in a direction that intersects a movement direction of said detection section, to achieve:

a function of first causing said detection section to be positioned on one side in said movement direction;

a function of then causing said transporting section to transport said medium to be printed in a predetermined direction up to a first detection position where said detection section detects said medium to be printed; and a function of then causing said detection section to move from the one side to the other side that is opposite from the one side in said movement direction, where said detection section detects a second upper end of said medium to be printed, wherein if said detection section detects that said second upper end is leading said first upper end by at least a set amount at said first detection position, causing said transporting section to transport said medium to be printed from said first detection position in a direction opposite from said predetermined direction, then causing said transporting section to transport said medium to be printed in said predetermined direction up to a second detection position where said detection section detects said medium to be printed, and then causing said transporting section to transport said medium to be printed by a predetermined amount in said predetermined direction from said second detection position, and wherein if said detection section detects that said first upper end is leading said second upper end, causing said transporting section to transport said medium to be printed in said predetermined direction from said first detection position by said predetermined amount without causing said transporting section to transport said medium to be printed from said first detection position in the direction opposite from said predetermined direction.

11. A computer system comprising:

a printing apparatus provided with a detection section that is capable of moving and that is for detecting a medium to be printed, and a transporting section for transporting the medium to be printed in a direction that intersects a movement direction of said detection section, a control section, and a main computer unit that is connected to said printing apparatus; wherein said control section of the printing apparatus:

first causes said detection section to be positioned on one side in said movement direction;

then causes said transporting section to transport said medium to be printed in a predetermined direction up to a first detection position where said detection section detects a first upper end of said medium to be printed; and then causes said detection section to move from the one side to the other side that is opposite from the one side in said movement direction, where said detection section detects a second upper end of said medium to be printed, and wherein if said detection section detects that said second upper end is leading said first upper end by at least a set amount at said first detection position, said control section causes said transporting section to transport said medium to be printed from said first detection position in a direction opposite from said predetermined direction, then causes said transporting section to transport said medium to be printed in said predetermined direction up to a second detection position where said detection section detects said medium to be printed, and then causing said transporting section to transport the medium to be printed by a predetermined amount in said predetermined direction from said second detection position, and wherein if said detection detects that said first upper end is leading said second upper end, said control section causes said transporting section to transport said medium to be printed in said predetermined direction from said first detection position by said predetermined amount without causing said transporting section to transport said medium to be printed from said first detection position in the direction opposite from said predetermined direction.

12. A printing apparatus comprising:

a sensor that is capable of moving and that is for detecting a medium to be printed;

a transport roller for transporting the medium to be printed in a direction that intersects a movement direction of said sensor; and a control section, wherein the control section first causes said sensor to be positioned on one side in said movement direction;

then causes said transport roller to transport said medium to be printed in a predetermined direction up to a first detection position where said sensor detects said medium to be printed; and then causes said sensor to move from the one side to the other side that is opposite from the one side in said movement direction, where the sensor detects a second upper end of said movement to be printed, and wherein if said sensor detects that said second upper end is leading said first upper end by at least a set amount at said first detection position, the control section causes said transport roller to transport said medium to be printed from said first detection position in a direction opposite from said predetermined direction, then causes said transport roller to transport said medium to be printed in said predetermined direction up to a second detection position where said sensor detects said medium to be printed, and then causes said transport roller to transport said medium to be printed by a predetermined amount in said predetermined direction from said second detection position, and wherein if said sensor detects that said first upper end is leading said second upper end, the control section causes said transport roller to transport said medium to be printed in said predetermined direction from said first detection position by said predetermined amount without causing said transporting roller to transport said medium to be printed from said first detection position in the direction opposite from said predetermined direction.

* * * * *